US006331039B1

(12) United States Patent
Iwasaki et al.

(10) Patent No.: US 6,331,039 B1
(45) **Date of Patent: *Dec. 18, 2001**

(54) INK JET RECORDING APPARATUS AND METHOD WITH MODULATABLE DRIVING PULSE WIDTH

(75) Inventors: Osamu Iwasaki, Kawasaki; Naoji Otsuka; Kentaro Yano, both of Yokohama; Kiichiro Takahashi, Kawasaki; Daigoro Kanematsu, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/509,667

(22) Filed: Jul. 31, 1995

(30) Foreign Application Priority Data

Jul. 29, 1994 (JP) ..... 6-179136

(51) Int. Cl.[7] ..... B41J 29/38

(52) U.S. Cl. ..... 347/11; 347/14; 347/13; 347/57; 347/60

(58) Field of Search ..... 347/14, 11, 13, 347/57, 60

(56) References Cited

U.S. PATENT DOCUMENTS

| | | | |
|---|---|---|---|
| 4,313,124 | | 1/1982 | Hara . |
| 4,345,262 | | 8/1982 | Shirato et al. . |
| 4,459,600 | | 7/1984 | Sato et al. . |
| 4,463,359 | | 7/1984 | Ayata et al. . |
| 4,558,333 | | 12/1985 | Sugitani et al. . |
| 4,608,577 | | 8/1986 | Hori . |
| 4,723,129 | | 2/1988 | Endo et al. . |
| 4,740,796 | | 4/1988 | Endo et al. . |
| 5,124,716 | * | 6/1992 | Roy ..... 347/11 |
| 5,559,535 | * | 9/1996 | Otsuka ..... 347/14 |
| 5,861,895 | * | 1/1999 | Tajika ..... 347/14 |

FOREIGN PATENT DOCUMENTS

| | | | |
|---|---|---|---|
| 0354982 | 2/1990 | (EP) | B41J/2/005 |
| 0445916 | 9/1991 | (EP) | B41J/2/05 |
| 0511602 | 11/1992 | (EP) | B41J/2/05 |
| 0605207 | 7/1994 | (EP) | B41J/2/05 |
| 5092565 | 4/1993 | (JP) | B41J/2/05 |
| 5169658 | 7/1993 | (JP) | B41J/2/05 |
| 5169659 | 7/1993 | (JP) | B41J/2/05 |
| 5220963 | 8/1993 | (JP) | B41J/2/125 |
| 59123670 | 7/1984 | (JP) | B41J/3/04 |
| 59138461 | 8/1984 | (JP) | B41J/3/04 |
| 60071260 | 4/1985 | (JP) | B41J/3/04 |
| 54056847 | 5/1979 | (JP) | B41M/5/26 |

* cited by examiner

*Primary Examiner*—Benjamin R. Fuller
*Assistant Examiner*—C. Dickens
(74) *Attorney, Agent, or Firm*—Fitzpatrick, Cella, Harper & Scinto

(57) ABSTRACT

An ink jet recording apparatus, in which thermal energy is applied to ink in accordance with a driving signal applied to a heater to produce a bubble, by which ink is ejected onto a recording material, includes a driver for applying a plurality of driving signals to the heater for one ejection of one ink droplet. The driving signals comprise a first driving signal not ejecting the ink and a second driving signal for ejecting the ink, the second driving signal being applied after a rest period after the first driving signal. The apparatus further includes a controller for changing an amount of ink ejected by changing a length of the rest period and changing the first driving signal. The controller effects its changing operation in a first changing region in which the rest period is changed without changing the first driving signal and in a second changing region in which a length of the first drive signal is changed.

32 Claims, 28 Drawing Sheets

| PWM No. | P0 (ST) | P1 (ST) | P2 (ST) | P3 (ST) |
|---|---|---|---|---|
| 1 | 14 | 0 | 4 | 30 |
| 2 | 14 | 1 | 4 | 29 |
| 3 | 14 | 2 | 4 | 28 |
| 4 | 14 | 3 | 4 | 27 |
| 5 | 14 | 4 | 4 | 26 |
| 6 | 14 | 5 | 4 | 25 |
| 7 | 14 | 6 | 4 | 24 |
| 8 | 14 | 7 | 4 | 23 |
| 9 | 14 | 8 | 4 | 22 |
| 10 | 14 | 9 | 4 | 21 |
| 11 | 13 | 9 | 5 | 21 |
| 12 | 12 | 9 | 6 | 21 |
| 13 | 11 | 9 | 7 | 21 |
| 14 | 10 | 9 | 8 | 21 |
| 15 | 9 | 9 | 9 | 21 |
| 16 | 8 | 9 | 10 | 21 |
| 17 | 7 | 9 | 11 | 21 |
| 18 | 6 | 9 | 12 | 21 |
| 19 | 5 | 9 | 13 | 21 |
| 20 | 4 | 9 | 14 | 21 |
| 21 | 3 | 9 | 15 | 21 |
| 22 | 2 | 9 | 16 | 21 |
| 23 | 1 | 9 | 17 | 21 |

FIG. 19

| EXCESS & DEFFICIENCY (ng) | PWM No. |
|---|---|
| ~ -10.1 | (HEAT CONTROL) |
| -10.0 ~ -9.6 | 23 |
| -9.5 ~ -9.1 | 22 |
| -9.0 ~ -8.6 | 21 |
| -8.5 ~ -8.1 | 20 |
| -8.0 ~ -7.1 | 19 |
| -7.0 ~ -6.1 | 18 |
| -6.0 ~ -5.1 | 17 |
| -5.0 ~ -4.1 | 16 |
| -4.0 ~ -3.1 | 15 |
| -3.0 ~ -1.6 | 14 |
| -1.5 ~ -0.1 | 13 |
| 0.0 ~ 1.9 | 12 |
| 2.0 ~ 2.9 | 11 |
| 3.0 ~ 3.6 | 10 |
| 3.7 ~ 4.2 | 9 |
| 4.3 ~ 4.9 | 8 |
| 5.0 ~ 5.6 | 7 |
| 5.7 ~ 6.2 | 6 |
| 6.3 ~ 6.9 | 5 |
| 7.0 ~ 7.6 | 4 |
| 7.7 ~ 8.2 | 3 |
| 8.3 ~ 8.9 | 2 |
| 9.0 ~ 1.0 | 1 |

FIG. 21

| RANK | PILMT(ST) | Pmain (ST) |
|---|---|---|
| 1 | 6 | 12 |
| 2 | 6 | 13 |
| 3 | 7 | 13 |
| 4 | 7 | 14 |
| 5 | 7 | 15 |
| 6 | 7 | 16 |
| 7 | 8 | 16 |
| 8 | 8 | 17 |
| 9 | 8 | 18 |
| 10 | 8 | 19 |
| 11 | 8 | 20 |
| 12 | 9 | 20 |
| 13 | 9 | 21 |

FIG. 23

| PWM No. | P0(ST) | P1(ST) | P2(ST) | P3(ST) |
|---|---|---|---|---|
| 1 | 14 | 0 | 4 | Pmain+9 |
| 2 | 14 | 1 | 4 | Pmain+8 |
| 3 | 14 | 2 | 4 | Pmain+7 |
| 4 | 14 | 3 | 4 | Pmain+6 |
| 5 | 14 | 4 | 4 | Pmaln+5 |
| 6 | 14 | 5 | 4 | Pmain+4 |
| 7 | 14 | 6 | 4 | Pmain+3 |
| 8 | 14 | 7 | 4 | Pmain+2 |
| 9 | 14 | 8 | 4 | Pmain+1 |
| 10 | 14 | 9 | 4 | Pmain |
| 11 | 13 | 9 | 5 | Pmain |
| 12 | 12 | 9 | 6 | Pmain |
| 13 | 11 | 9 | 7 | Pmain |
| 14 | 10 | 9 | 8 | Pmain |
| 15 | 9 | 9 | 9 | Pmain |
| 16 | 8 | 9 | 10 | Pmain |
| 17 | 7 | 9 | 11 | Pmain |
| 18 | 6 | 9 | 12 | Pmain |
| 19 | 5 | 9 | 13 | Pmain |
| 20 | 4 | 9 | 14 | Pmain |
| 21 | 3 | 9 | 15 | Pmain |
| 22 | 2 | 9 | 16 | Pmain |
| 23 | 1 | 9 | 17 | Pmain |

FIG. 24

| PWM No. | P0 (ST) | P1 (ST) | P2 (ST) | P3 (ST) |
|---|---|---|---|---|
| 1 | 15 | 0 | 4 | Pmain+8 |
| 2 | 15 | 1 | 4 | Pmain+7 |
| 3 | 15 | 2 | 4 | Pmain+6 |
| 4 | 15 | 3 | 4 | Pmain+5 |
| 5 | 15 | 4 | 4 | Pmain+4 |
| 6 | 15 | 5 | 4 | Pmain+3 |
| 7 | 15 | 6 | 4 | Pmain+2 |
| 8 | 15 | 7 | 4 | Pmain+1 |
| 9 | 15 | 8 | 4 | Pmain |
| 10 | 14 | 8 | 5 | Pmain |
| 11 | 13 | 8 | 6 | Pmain |
| 12 | 12 | 8 | 7 | Pmain |
| 13 | 11 | 8 | 8 | Pmain |
| 14 | 10 | 8 | 9 | Pmain |
| 15 | 9 | 8 | 10 | Pmain |
| 16 | 8 | 8 | 11 | Pmain |
| 17 | 7 | 8 | 12 | Pmain |
| 18 | 6 | 8 | 13 | Pmain |
| 19 | 5 | 8 | 14 | Pmain |
| 20 | 4 | 8 | 15 | Pmain |
| 21 | 3 | 8 | 16 | Pmain |
| 22 | 2 | 8 | 17 | Pmain |
| 23 | 1 | 8 | 18 | Pmain |

FIG. 25

| PWM No. | P0 (ST) | P1 (ST) | P2 (ST) | P3 (ST) |
|---|---|---|---|---|
| 1 | 16 | 0 | 4 | Pmain+7 |
| 2 | 16 | 1 | 4 | Pmain+6 |
| 3 | 16 | 2 | 4 | Pmain+5 |
| 4 | 16 | 3 | 4 | Pmain+4 |
| 5 | 16 | 4 | 4 | Pmain+3 |
| 6 | 16 | 5 | 4 | Pmain+2 |
| 7 | 16 | 6 | 4 | Pmain+1 |
| 8 | 16 | 7 | 4 | Pmain |
| 9 | 15 | 7 | 5 | Pmain |
| 10 | 14 | 7 | 6 | Pmain |
| 11 | 13 | 7 | 7 | Pmain |
| 12 | 12 | 7 | 8 | Pmain |
| 13 | 11 | 7 | 9 | Pmain |
| 14 | 10 | 7 | 10 | Pmain |
| 15 | 9 | 7 | 11 | Pmain |
| 16 | 8 | 7 | 12 | Pmain |
| 17 | 7 | 7 | 13 | Pmain |
| 18 | 6 | 7 | 14 | Pmain |
| 19 | 5 | 7 | 15 | Pmain |
| 20 | 4 | 7 | 16 | Pmain |
| 21 | 3 | 7 | 17 | Pmain |
| 22 | 2 | 7 | 18 | Pmain |
| 23 | 1 | 7 | 19 | Pmain |

FIG. 26

| PWM No. | P0 (ST) | P1 (ST) | P2 (ST) | P3 (ST) |
|---|---|---|---|---|
| 1 | 17 | 0 | 4 | Pmain+6 |
| 2 | 17 | 1 | 4 | Pmain+5 |
| 3 | 17 | 2 | 4 | Pmain+4 |
| 4 | 17 | 3 | 4 | Pmain+3 |
| 5 | 17 | 4 | 4 | Pmain+2 |
| 6 | 17 | 5 | 4 | Pmain+1 |
| 7 | 17 | 6 | 4 | Pmain |
| 8 | 16 | 6 | 5 | Pmain |
| 9 | 15 | 6 | 6 | Pmain |
| 10 | 14 | 6 | 7 | Pmain |
| 11 | 13 | 6 | 8 | Pmain |
| 12 | 12 | 6 | 9 | Pmain |
| 13 | 11 | 6 | 10 | Pmain |
| 14 | 10 | 6 | 11 | Pmain |
| 15 | 9 | 6 | 12 | Pmain |
| 16 | 8 | 6 | 13 | Pmain |
| 17 | 7 | 6 | 14 | Pmain |
| 18 | 6 | 6 | 15 | Pmain |
| 19 | 5 | 6 | 16 | Pmain |
| 20 | 4 | 6 | 17 | Pmain |
| 21 | 3 | 6 | 18 | Pmain |
| 22 | 2 | 6 | 19 | Pmain |
| 23 | 1 | 6 | 20 | Pmain |

FIG. 27

CYL
FIG. 28A HLARTCH
FIG. 28B HDATA
128or136
FIG. 28C HCLOCK
(a)
FIG. 28D Odd ENB
FIG. 28E Even ENB
FIG. 28F B ENB 0
FIG. 28G B ENB 1
FIG. 28H B ENB 2
FIG. 28I H ENB 0.1.2
FIG. 28J H ENB 3
(b)
BLK
FIG. 28K Odd ENB
FIG. 28L Even ENB
FIG. 28M B ENB 0
FIG. 28N B ENB 1
FIG. 28O B ENB 2
FIG. 28P H ENB 0.1.2
FIG. 28Q H ENB 3
(c)
BLK (d)

P1 P3

INK JET RECORDING APPARATUS AND METHOD WITH MODULATABLE DRIVING PULSE WIDTH

FIELD OF THE INVENTION AND RELATED ART

The present invention relates to ink jet recording apparatus and method in which a driving pulse width is modulatable.

Recently, various types of printers have been developed as output devices for personal computers, word processors, facsimile machines or the like in offices. Among such printers, an ink jet type printer, in which ink is ejected to a recording material, is advantageous in that the recording noise level is low, that high quality recording is possible, that downsizing is easy, or the like.

Among ink jet recording type printers, a cartridge type is widely used in which an ink container for containing ink and a recording head for converting an electric signal to thermal energy by a electrothermal transducer element to produce film boiling of the ink so that the ink is ejected by a pressure of a bubble created by the boiling are provided.

The ink jet cartridge is advantageous in that the cost can be reduced because the passages between the recording head and the ink container are shortened, and in addition, the ink consumption for ink ejection recovery operation is minimized. If the quantity of the ink in the ink container corresponds to the service life of the recording head, the exchange of the cartridge by a user, in effect, performs the maintenance operation for the recording head and for the ink replenishment. Corresponding to the intention of the user, color recording and monochromatic recording cartridges are exchangeable in some machines already on sale.

In the recording apparatus using such a recording head, a driving pulse applied to the electrothermal transducer is determined in consideration of a quantity of the heat per unit area of an ink contact surface of the electrothermal transducer element and durability against stress caused by the heat.

On the other hand, as one of conditions for accomplishing high quality of the image in an Ink jet recording apparatus, there is information of ink ejection quantity to avoid non-uniformity In the image. In one example to achieve this, a temperature (ambient temperature) under which the recording-head cartridge is placed, and the temperature of the recording head per se, are taken into account for the control of the driving pulse. This is because the viscosity and the surface tension or the like of the ink changes in accordance with the ambient temperature with the result of change of the flow resistance in the ink supply system including ink container and ink supply path or the like and because the change of the temperature of the recording head namely the temperature of the ink in the ejecting portion results in the change in the ink ejection amount as the case may be. In such a case, if the driving pulses are constant, the ejection amount changes, and therefore, the uniformity is not achieved.

FIG. 2 is a diagram representing ambient temperature dependency of the ejection amount when the driving pulse condition is fixed, in which Tenv is the ambient temperature and Vd is the ejection amount.

As shown in the Figure, the ejection amount linearly increases with increase of the ambient temperature. The inclination of the line is defined as ambient temperature dependence coefficient, which is expressed as follows:

$$Kenv=\delta Vd/\delta Tenv[p1/^{\circ}C.drop]$$

The coefficient Kenv is determined by the structure of the recording head cartridge, ink property and the like.

FIG. 3 is a diagram of a dependency of the ejection amount on the head temperature (the head temperature is equal to the ink temperature in the ejecting portion because the temperature property is static) when the driving pulse is fixed.

As shown in this Figure, the ejection amount Vd substantially linearly increases in the temperature range shown therein with increase of the head temperature TH. The inclination is defined as a head temperature dependence coefficient KH, which is expressed:

$$Ki=\delta Vd/\delta TH[p1/^{\circ}C./drop]$$

The coefficient KR is also determined by the ink property or the like.

It has been proposed in an application having been assigned to the assignee of this application that the change of the ejection amount due to the ink temperature variation is removed by PWM (pulse width modulation) driving for the electrothermal transducer elements (ejection heaters) to accomplish a constant ejection amount.

FIG. 4 illustrates divided pulses relating to the PWM drive.

In this Figure, the ordinate represents a driving voltage applied (v), and the abscissa represents the time period of the application of the pulse. In the Figure, P1 is a pulse width of the first one (pre-pulse) of the divided heat pulses; P3 is a pulse width of the second pulse (main pulse); P2 is an interval time (rest period) between the pulses P1 and P2; and T0, T1, T2, T3 are time periods for determining P1, P2 and P3.

The PWM ejection amount controls are classified into two types. One of them is as disclosed In Japanese Laid-Open Patent Application No. 92565/1993. This method is shown in FIG. 5, wherein the time periods T2 and T3 are constant, and the period T1 is modulated. In other words, the width P1 of the prepulse is modulated. This will be called prepulse width modulation driving method. With this driving method shown in FIG. 5, the interval time P2 is also modulated in accordance with the modulation of the prepulse. Another method is as disclosed in Japanese Laid-Open Patent Application No. 169659/1993, for example. This is shown in FIG. 6 of this application, the time intervals (T1−T0) and (T3−T2) are constant, and the time interval (T2−T1) is modulated. In other words, the pulse width interval time) P2 between the prepulse P1 and the main pulse P3 is modulated without changing the pulse widths of the prepulse P1 and the main pulse P3. This is called V interval time modulation driving method.

Referring to FIG. 7, the change of the ejection amount in the prepulse width modulating method will be described. In FIG. 7, the ordinate represents ejection amount Vd, and the abscissa represents a width of the prepulse P1, wherein arN designates non-ejection area wherein the ink is not ejected, and arB is a bubble formation area wherein the ink is ejected by the prepulse P1. FIG. 7 shows the change of the ejection amount when the main pulse P1 is constant.

With the increase of T1 namely P1, the ejection amount increases. When a predetermined peak is exceeded, it is decreased, and falls in the region of bubble formation by the width P1. With this driving method, the setting of T1 may be optimized, so that the linearity in the change of the ejection amount relative to the modulation of T1 can be provided, in which case, the control is easy.

Referring to FIG. 8, the description will be made as to the interval time modulation method. In FIG. 8, the ordinate represents the ejection amount Vd, the abscissa represents the interval time t.

With the increase of the interval time P2, the ejection amount increases, and falls in an area arN incapable of bubble formation. With this driving method, it is preferable that the prepulse width is maximum under the condition that the bubble is not formed. In this case, it is equal to the maximum of P1 in the prepulse width modulation driving method. In this driving method, the temperature increase of the recording head is a problem. When the temperature rise is suppressed by not using the divided pulses in the high temperature area and decreasing the pulse width (single pulse), (T2−T1) is decreased with increase of the temperature, and (T1−T0) is reduced from the point of time at which (T2−T1) is zero. By doing so, the above-described control can be effected, and therefore, the modulation is possible with maintenance of the continuity of the pulse width. FIG. 9 shows a pulse profile upon P2=(T2−T1)=0.

In either of the prepulse width modulating driving method and an interval time modulation driving method, the maximum width of the overall pulses (T3−T0) is limited by driving frequency or the like from the standpoint of head driving. Therefore, (T3−T0) is the same in both of the methods. When the main pulse P3 has the same width in one period, the waveforms of the driving pulses providing the maximum ejection amounts in both of the driving methods, are the same in configurations. If the ejection properties of them are the same, the maximum ejection amounts are the same.

It is assumed that the minimum unit determined by a logic circuit for the pulse controls 1st=0.181 $\mu$sec, and the total length of the driving pulse T3 is 47st, and that the maximum width of the prepulse is 9st, and the pulse width of the main pulse 21st. Under these conditions, the number of modulation steps in the prepulse width modulation method is not more than 9 steps depending on the minimum unit of the logic circuit and the maximum width of the prepulse. On the other hand, in the case of the interval time modulation method, the maximum interval time is 17st (47−9−21), and therefore, the number of modulation steps is 17.

However, the current actually flowing through the ejection heater is not exact, that is, has a trail as indicated by ta in FIG. 10, despite the configuration of the driving pulse. The length of the trail ta is different depending on the performance of the driver for driving the ejection heater or the like. Thus, the problem that the number of usable steps for the modulation in the PWM driving method is limited, has been found. For example, if the width of the trail ta is approx. 4st, and if the interval time P2 is 0−4st in the interval time modulating method, the current pulse actually flowing through the ejection heater is a single pulse, in effect, by the resulting continuity between the prepulse P1 and the main pulse P2, as shown in FIG. 11. With the single pulse, the ejection amount control is difficult, and therefore, the number of steps usable for the modulation reduces to 13 steps.

SUMMARY OF THE INVENTION

Accordingly, It is a principal object of the present invention to provide an ink jet recording method and apparatus in which the problem of decrease of the modulating step number in the interval time modulation method is improved.

It is another object of the present invention to provide an ink jet recording method and apparatus in which continuous ejection amount modulation is possible.

According to an aspect of the present invention, there is provided an ink jet recording apparatus in which thermal energy is applied to ink in accordance with a driving signal applied to a heater to produce a bubble, by which ink is ejected onto a recording material, comprising: driving means for applying a plurality of driving signals to the heater for one ejection of ink droplet, wherein the driving signals comprise a first driving signal not ejecting the ink and a second driving signal for ejecting the ink, the second driving signal is applied after a rest period after the first driving signal; changing means for changing an amount of ink ejected by changing a length of the rest period and changing the first driving signal; wherein the changing means effects its changing operation in a first changing region in which the rest period is changed without changing the first driving signal and in a second changing region in which a length of the first drive signal is changed.

According to another aspect of the present invention, there is provided an ink jet recording method in which ink is supplied with thermal energy in accordance with a driving signal applied to a heater to produce a bubble, by which the ink is ejected onto a recording material, and wherein a plurality of driving signals for one droplet ink ejection are applied, comprising the steps of: supplying a first driving signal to increase a temperature of the ink adjacent the heater; providing a rest period after the first step; supplying a second driving signal to produce a bubble in the ink to eject the ink; changing the first driving signal and a length of the rest period to change the amount of the ink ejected; wherein the changing step effects the changing in a first changing region in which the rest period is changed without changing the first driving signal and in a second changing region in which the length of the first driving signal is changed.

Even if the current flowing through the recording element (ejection heater) has a trail due to the property of the head driver or the like, the interval period of the driving pulses for driving the heater is made larger than the time width (length), so that the continuity of the driving pulses can be prevented.

In the PWM driving method in which the ejection amount is controlled by controlling the signal width of the driving signals, the interval time is modulated in the area where the interval time is longer than the trail, and the signal width of the driving signal (prepulse) supplied prior to the interval time is modulated, by which the ejection amount can be smoothly changed without decrease the number of steps for the effective pulse width modulation.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 19 is a PWM table for the head drive pulse control according to a first embodiment of the present invention.

FIG. 21 shows a PWM number selection table for the head drive pulse control according to the first embodiment.

FIG. 23 shows a table of relationship between the prepulse and the main pulse in an interval control area in accordance with a rank of heat generation amount of the recording head according to a second embodiment of the present invention.

FIG. 24 shows a PWM table of the driving pulse in the case of the maximum prepulse 9st for the recording head according to the second embodiment.

FIG. 25 is a PWM table for the driving pulse control in the case of the maximum prepulse 8st of the recording head according to the second embodiment.

FIG. 26 shows a PWM table for a drive pulse control in the case of the maximum prepulse 7st for the recording head according to the second embodiment of the present invention.

FIG. 27 is a PWM table for the driving pulse in the case of the maximum prepulse 6st for the recording head according to the second embodiment of the present invention.

FIGS. 28A–28R comprise a timing chart for transfer of various signals in the head driving circuit shown in FIG. 18.

DESCRIPTION OF THE PREFERRED EMBODIMENTS

Referring to the accompanying drawings, the embodiments of the present invention will be described in detail.

FIGS. 12–17 illustrate an ink jet unit IJU, ink jet head IJH, ink container IT, ink jet cartridge IJC, ink jet recording apparatus main assembly IJRA, carriage HC, and the relationship among them, according to the embodiments of the present invention.

(i) Main Assembly of the Apparatus

Figure 12:
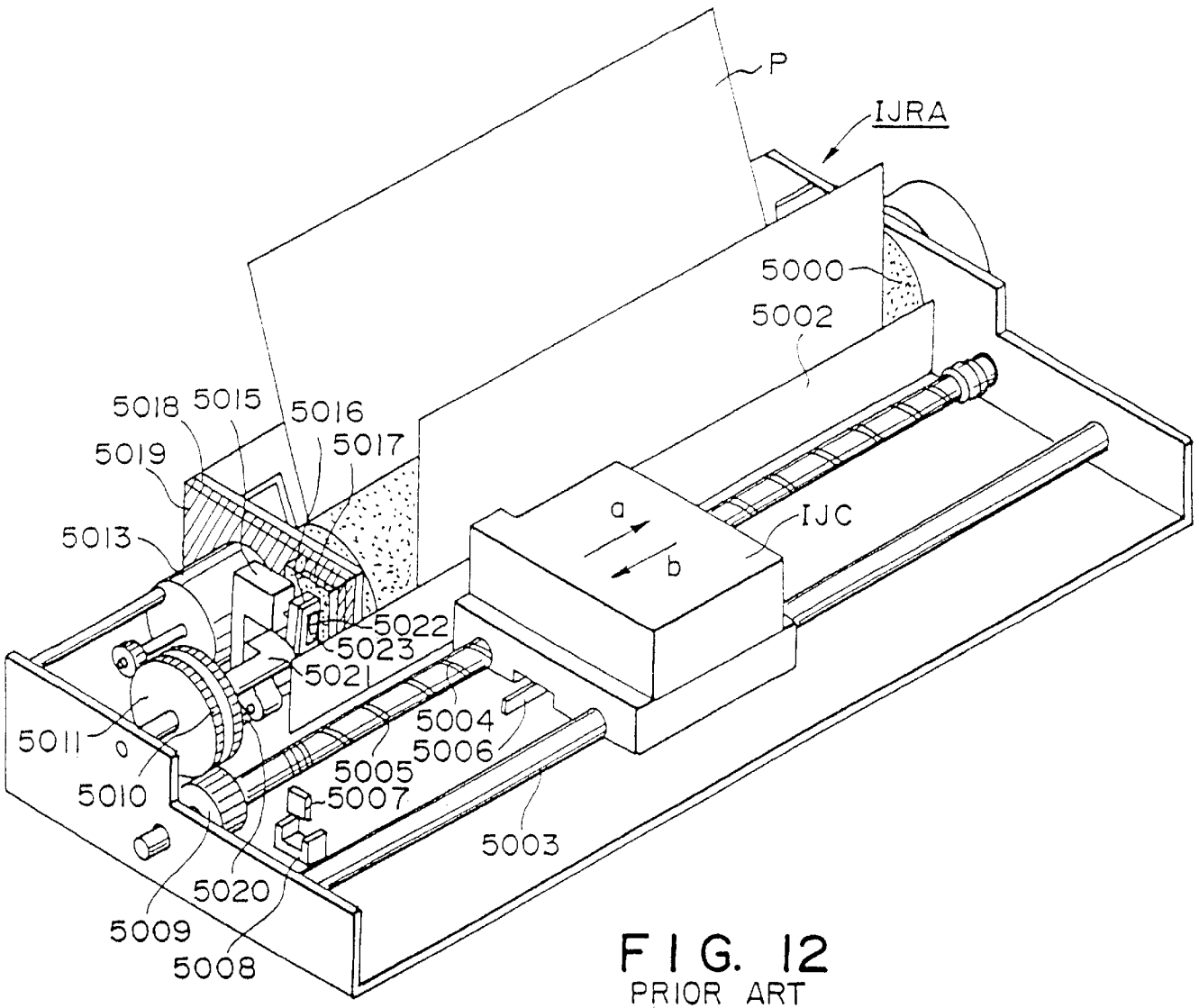
FIG. 12 PRIOR ART
FIG. 12 is a perspective view of an ink jet recording apparatus according to an embodiment of the present invention.

FIG. 12 shows an example of an ink jet recording apparatus IJRA to which the present invention is applicable. In this Figure, a carriage HC is engaged with a helical groove 5004 of a lead screw 5005 rotated by drive transmission gears 5011 and 5009 by a reversible driving motor 5013. The carriage HC has a pin (not shown) engaged with the helical groove 5004. By this, it is reciprocable in the directions a and b. The carriage HC carries an ink jet cartridge IJC. Designated by 5002 is a sheet confining plate and confines the sheet on the platen 5000 along the movement direction of the carriage. Elements 5007 and 5000 constitute a photocoupler to detect the presence of a lever 5006 of the carriage in this area to switch the rotational direction of the motor 5013. The photocoupler functions as a home position detecting means. Designated by 5016 is a member for supporting a capping member 5022 for capping a front face of a recording head. Designated by 5015 is a sucking means for sucking the space in the cap to recover the recording head through an opening 5023 of the cap. A cleaning blade 5017 is movable to and fro by a member 5019. They are supported on a supporting plate 5018. The blade is not limited to this type, but any known cleaning blade is usable.

Arm 5021 is used to start the sucking operation, and moves with the movement of the cam 5020 engaged with the carriage. The driving force from the driving motor is controlled by known transmitting means such as clutch or the like.

The capping, cleaning and the sucking recovery operation, are carried out when the carriage comes to the home position. By the function of the lead screw 5005, these operations can be carried out. However, this is not limiting, and the desired operations are carried out at known predetermined timing.

Figure 13:
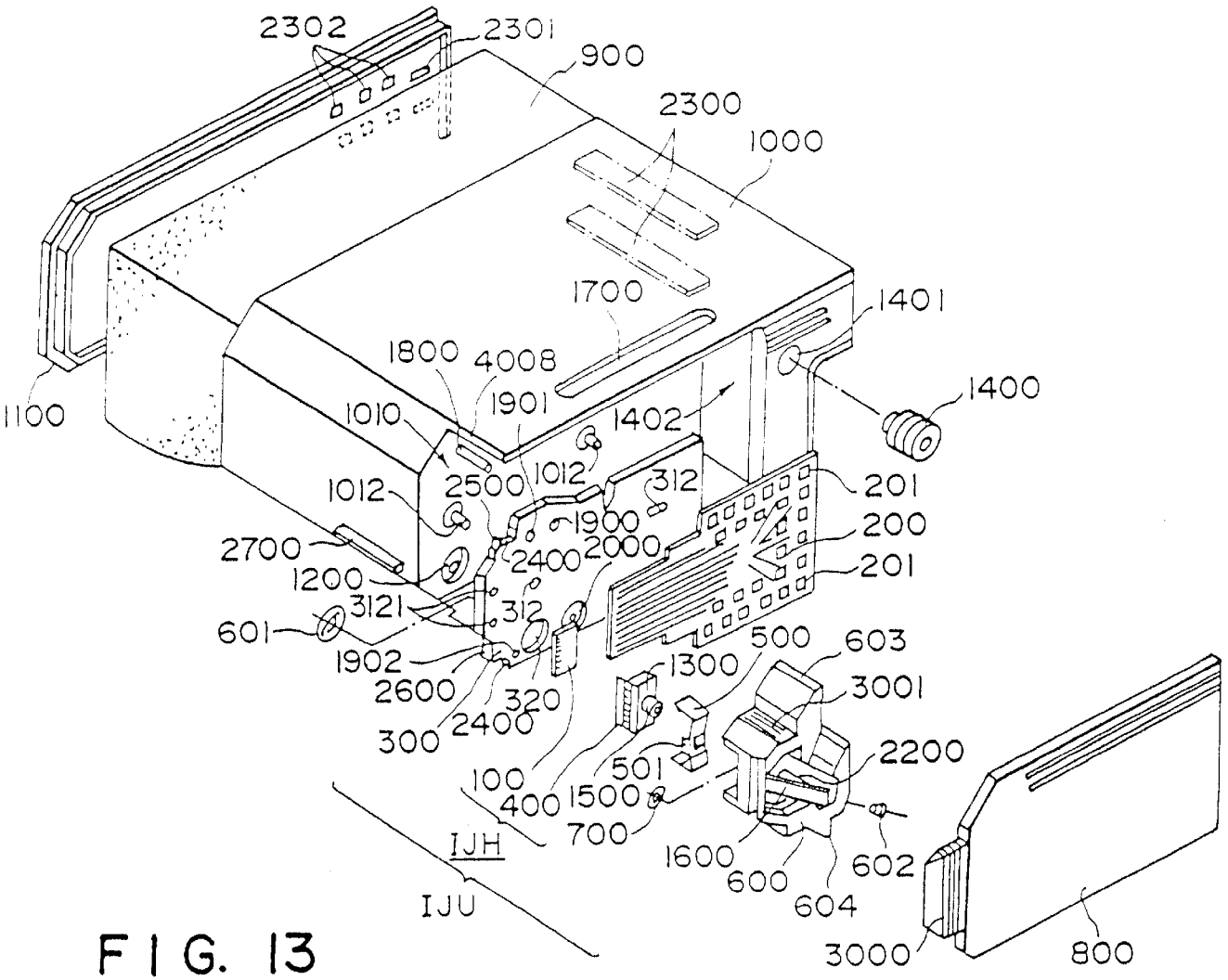
FIG. 13 PRIOR ART
FIG. 13 is an exploded perspective view of a cartridge usable with the apparatus of FIG. 12.
Figure 14:
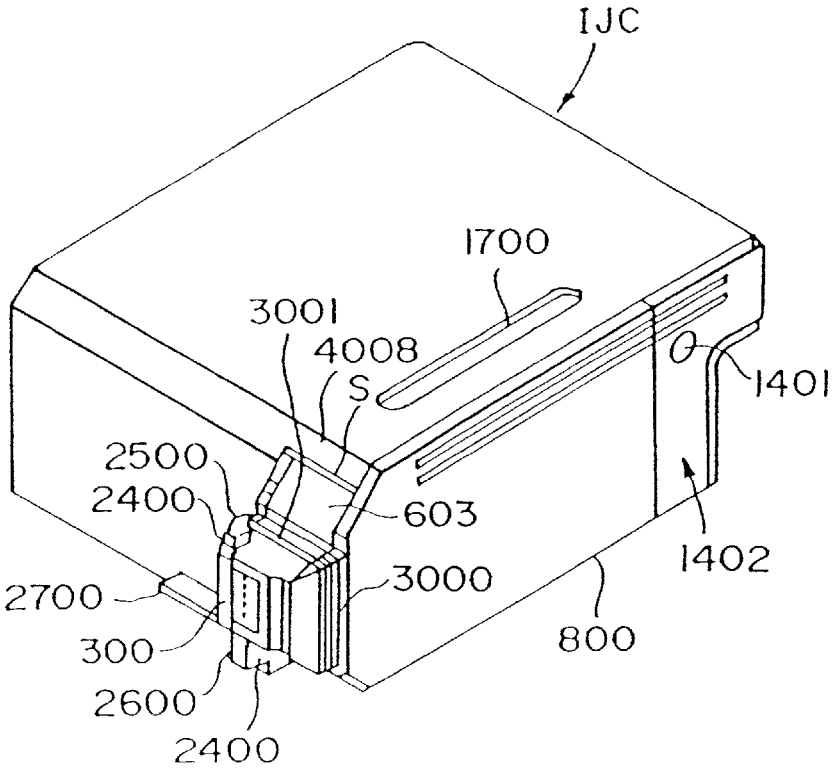
FIG. 14 PRIOR ART
FIG. 14 is an outer perspective view of the cartridge.

In the ink jet cartridge IJC, as will be understood from FIG. 13, the percentage of the ink containing portion is large, and the end of the ink jet unit IJU is slightly projected beyond a front face of the ink container IT. The ink jet cartridge IJC is securedly supported by known positioning means (which will be described hereinafter) for the carriage HC (FIG. 12) in the main assembly IJRA and the electric contacts. It is detachable to the carriage HC.

(ii) Ink Jet Unit IJU

The ink jet unit IJU uses an electrothermal transducer for generating thermal energy for creating film boiling in the ink in response to an electric signal.

Referring to FIG. 13, a heater board 100 has an Si substrate, an array of electrothermal transducers (ejection heater), and electric wiring of Al or the like for supplying the electric energy thereto. A wiring board 200 for supplying the electric energy to the heater board 100 comprises wiring corresponding to the wiring of the heater board (they are connected by wire bonding or the like), and pads at ends of wiring to receive electric signals from the main assembly.

A grooved top plate 1300 comprises grooves for forming partition walls for ink passages and a common liquid chamber or the like. It comprises an ink receiving port for receiving the ink from the ink container into the common liquid chamber, and an orifice plate 400 having a plurality of ejection outlets, which are integrally formed. The material for the integral formation or molding is preferably polysulfone resin material, but another molding resin material is usable.

A support 300 is of metal and functions to support the backside of the wiring board 200 in a flat plane, and is a bottom plate of the ink jet unit. A confining spring 500 has M-shaped form, the central portion thereof confines the common liquid chamber, and an apron portion 501 urges a part of the liquid passages along a line. The legs of the confining spring are penetrated through holes 3121 and are engaged with the backside of the support 300, by which the heater board 100 and the top plate 1300 are sandwiched, and they are pressed to each other by the urging force of the confining spring 500.

The support 300 comprises positioning holes 312, 1900 and 2000 engageable with two positioning projections 1012 and positioning and fusing projections 1800 and 1801 of the ink container IT, and in addition, it comprises on the backside thereof positioning projections 2500 and 2600 for the carriage HC of the main assembly IJRA. Additionally, it comprises a hole 320 through which ink supply tube 2200, which will be described hereinafter, is penetrated to permit ink supply from the ink container. The mounting of the support 300 to the wiring board 200 is bonded by bonding material or the like. The recesses 2400 and 2400 of the support 300 are disposed adjacent the positioning projections 2500 and 2600. In the ink jet cartridge IJC (FIG. 14) after being assembled, the three sides are disposed in an extension of a head end constituted by a plurality of parallel grooves 3000 and 3001 to prevent foreign matters such as ink dust or the like from reaching the projections 2500 and 2600. The cover member 800, as shown in FIG. 13, constitutes an outer wall of the ink jet cartridge IJC, and also forms a space for accommodating the ink jet cartridge IJU. The ink supply member 600 in which the parallel groove 3001 is formed, has an ink supply conduit 1600 in communication with the above-described ink supply tube 2200, and the ink supply tube 2000 side thereof is fixed, so that it is in the form of a cantilever. A sealing pin 602 is inserted to assure the capillary force between the ink supply tube 2200 and the fixed side of the ink conduit. Designated by a reference numeral 601 is a gasket for sealing between the ink container IT and the supply tube 2200, and 700 is a filter provided in the container side end of the ink supply tube.

The ink supply member 600 is produced by molding, and therefore, it is inexpensive and the positional accuracy is assured. Additionally, during the mass-production, the press-contact to the ink receiving port 1500 can be assured by the cantilever conduit 1600. In this embodiment, under this pressed state, the sealing bonding agent is supplied from the ink supply portion side, which Ls sufficient to assure the fluid communication. The ink supply member 600 is fixed to the support 300 by penetrating the backside pin (not shown) of the ink supply member 600 through the holes 1901 and 1902 of the support 300, and heat fusing the projected portions of the pins onto the backside of the support 300. The small projections provided by the heat fusing, are accommodated in a recess of a wall of the ink container IT, and therefore, the positioning of the unit IJU can be correctly accomplished.

(iii) Ink Container

The ink container comprises a cartridge main assembly 1000 and an ink absorbing material 900. The ink container 900 is inserted into the main body of the cartridge 1000 from the side opposite from the side where it is mounted to the unit IJU, and thereafter, the main body 100 is capped with a covering member 1100. The ink absorbing material absorbs the ink and is within the main body of the cartridge 1000. Designated by 1200 is a supply port for supplying the ink to the unit IJU, and it also functions as an ink filling port for supplying the ink to the absorbing material 900 before the unit is mounted to the portion 1010 of the cartridge main body 100.

In this example, the portions capable of supplying the ink, are only the air vent and the supply port. The air existing region of the container formed by ribs 2300 In the main body and ribs 2500 and 2400 of the cover 1100 to improve the ink supply properly from the ink absorbing material, Is extended from the air vent 1401 side to the corner farthest from the ink supply port 1200. Therefore, the ink supply to the ink absorbing material is preferably carried out through the supply port 1200 for the purpose of relatively uniform and sufficient ink supply thereto. Four of such ribs 1000 are provided in parallel with the carriage movement direction behind the main body 1000 of the ink container, thus preventing the close contact of the absorbing material to the rear surface. Partial ribs 2400 and 2500 are formed in the inside surface of the cover 1100 on an extension of the rib 1000. However, it is divided as contrasted to the rib 1000 to increase the air existing space. The partial ribs 2500 and 2400 are dispersed in a space smaller than one half of the total area of the cover member 1000. By these ribs, the ink in the corner region farthest from the supply port 1200 can be assuredly supplied to the supply port 1200 by the capillary force. An air vent 1401 is formed in the cover for communication between the ambience and the inside of the cartridge. Designated by 1400 is a water repelling material disposed in the air vent 1401, by which the ink leakage through the air vent 1401 is prevented.

The ink containing space of the ink container IT is rectangular, and the long side may be at the side, and the positions of the ribs are particularly effective. When the long side is along the carriage movement direction, or when it is in the form of a cube, the rib may be provided along the entire length of the cover member 1100, so that the ink supply from the ink absorbing material 900 is stabilized.

Figure 15:
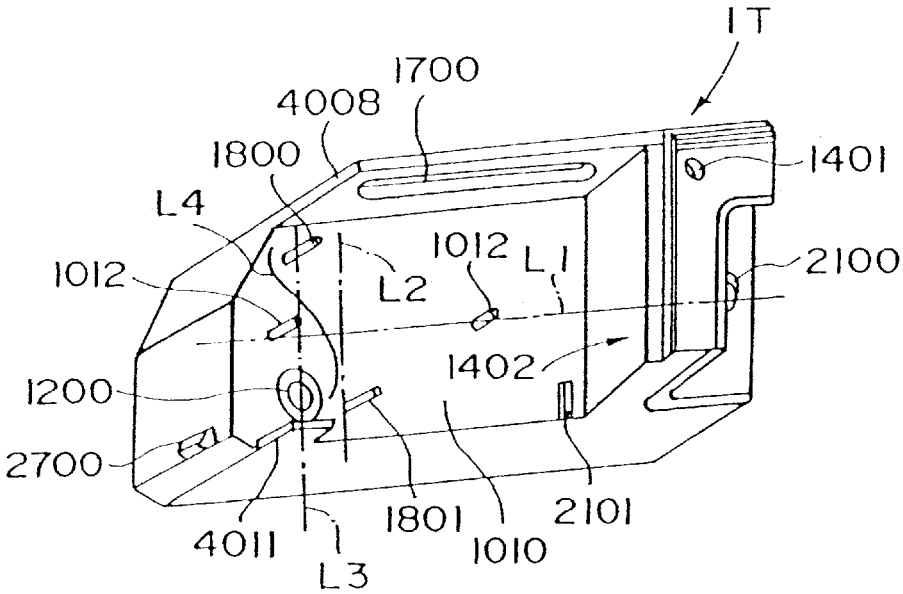
FIG. 15 PRIOR ART
FIG. 15 is a perspective view illustrating engagement between an ink container and a recording head constituting the cartridge.

The structure of the mounting surface of the ink container against the unit IJU is shown in FIG. 15. Here, a line L1 is extended substantially through the center of the ejection outlet of the orifice plate 400 and parallel with a mounting reference surface of the carriage surface or the bottom surface of the container IT. Two positioning projections 1012 engagaable with a hole 312 of the support 900 is on the line L1. The height of the projection 1012 is slightly smaller than the thickness of the support 300 to permit positioning of the support 300. On an extension of the line L1 on the Figure is provided a claw 2100 for engagement with an engaging surface 4002 of 90 degrees angle of positioning hook 4001 of the carriage, So that the positioning force relative to the cartridge acts in a surface region parallel with the reference surface including the line L1. As will be described hereinafter in conjunction with FIG. 15, the relationships are advantageous since the positional accuracy of the ink container is equivalent with the positional accuracy of the head ejection outlet.

The projections 1800 and 1801 of the ink container corresponding to the fixing holes 1900 and 2000 for the fixing to the side surface of the ink container, are longer than the above-described projections 1012, and the projected portions are heat fused, thus fixing the support 300 to the side surface thereof. Designated by L3 is a line perpendicular to the line L1 and passing through the projection 1800, and L2 is a line passing through the projection 1801. On the line L3, substantial center of the supply port 1200 is disposed, and therefore, the connection between the supply port 1200 and the supply tube 2200 is stabilized. The shock due to falling or impact to the connecting portion can be released. The lines L2, L3 are not the same, and the projections 1800 and 1801 are adjacent the projection 1012 adjacent the ejection outlet side of the head IJH, and therefore, the reinforcing effect for the positioning of the head IJH to the container is enhanced. A curve designated by L4 is an outer wall position when the ink supply member 600 is mounted. Since the projections 1800 and 1801 are along the line L4, the sufficient strength and positional accuracy are provided against the weight of the leading portion structure of the head IJH. Designated by 2700 is a flange at an end of the ink container IT, it is inserted into a hole of a front plate 4000 of the carriage to prevent the situation in which the position of the ink container is extremely wrong. Designated by 2101 is a further positioning and engaging portion relative to the carriage HC.

The ink container IT encloses except for the bottom opening the unit IJU by covering with the cap 800 after the unit IJU is mounted. As for the ink jet cartridge IJC, the bottom opening for mounting on the carriage HC La close to the carriage HC, and therefore, it constitutes a four side closed space, substantially. Therefore, the heat generation from the head IJH in the enclosed space is effective to maintain the temperature in the space. However, for the long term continuous use, small temperature rise occurs. For this reason, in this embodiment, in order to assist the spontaneous heat radiation of the supporting member, the upper surface of the cartridge IJC is provided with a small width slit 1700 in communication with the space to prevent the temperature rise, while the temperature distribution in the entirety of the unit IJU is not influenced by the ambience.

When the ink cartridge IJC is assembled, the ink is supplied to the ink container 600 from the inside of the cartridge through the supply port 1200, the hole 320 in the support 300 and an inlet in the inside back portion of the supply container 600. After passing through the ink container 600, the ink is supplied into the common liquid chamber through the supply tube, ink inlet 1500 of the top plate 400. In the connecting portion, a gasket of silicon rubber or butyl rubber is provided to effect the sealing to assure the ink supply path.

In this embodiment, the top plate 1300 is of polysulfone, polyethersulfone, polyphenylene oxide, polypropylene or like resin materials durable against ink. It is simultaneously and integrally molded in a metal mold together with the orifice plate 400.

As described, the integral molded part contains ink supply member 600, top plate, orifice plate and the main body 1000 of the ink container, and therefore, the assembling accuracy is high, and is extremely effective to improve the quality in the mass-production. The number of parts is reduced as compared with the conventional structure, and the excellent properties can be assuredly provided.

(iv) Mounting of the Ink Jet Cartridge IJC to the Carriage HC

Figure 16:
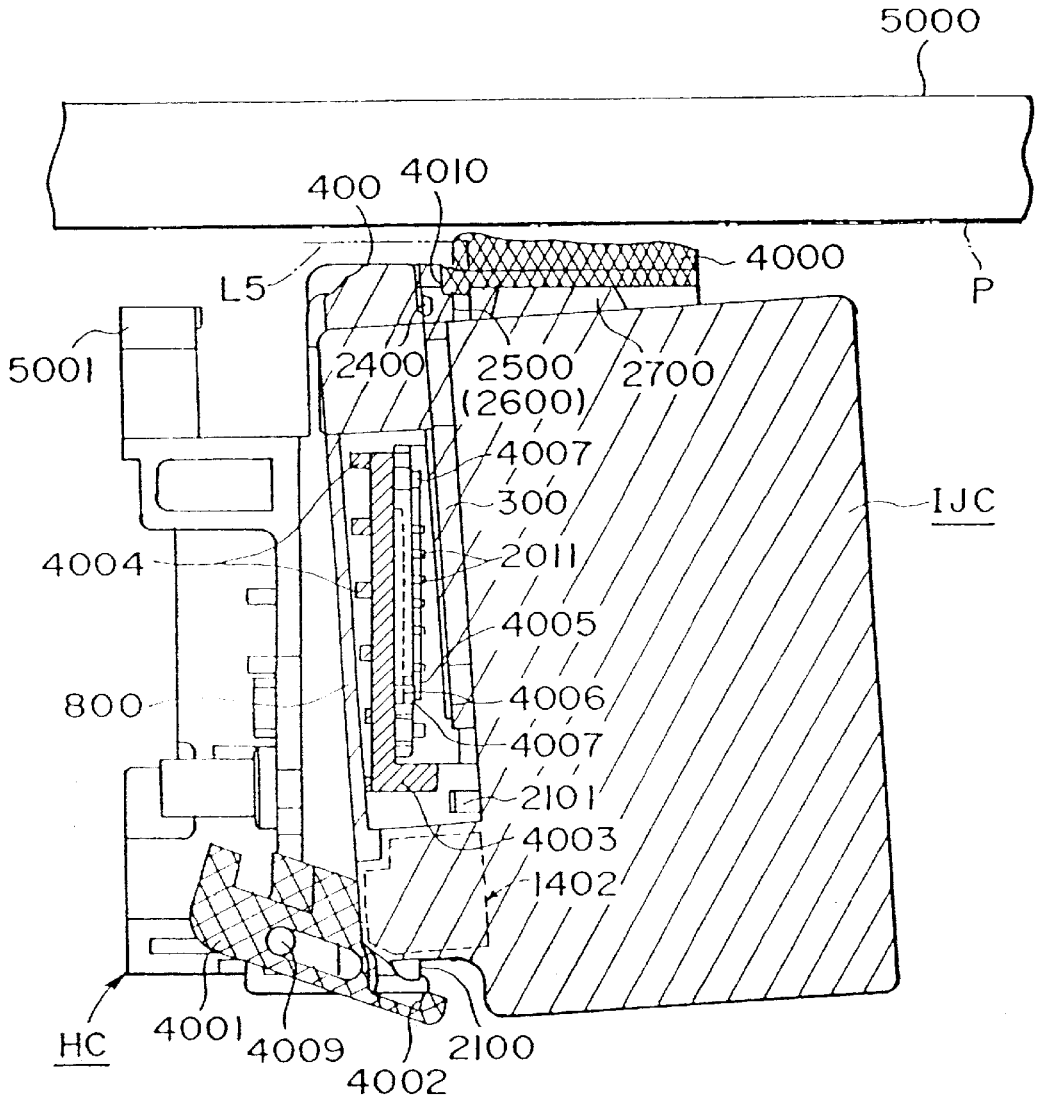
FIG. 16 PRIOR ART
FIG. 16 illustrates mounting and demounting of the cartridge relative to the carriage.

In FIG. 16, a platen roller 5000 guides the recording material P from the bottom side. The carriage HC moves along the platen roller 3000. In front of the carriage, that is, adjacent the platen there is provided a front plate 400 having thickness of approx. 2 mm at the front side of the ink jet cartridge IJC, a flexible sheet 4005 having a pad 2001 corresponding to the pad 201 of the wiring board 200 of the cartridge IJC, and an electric contact supporting plate 4003 for supporting the rubber pad 4006 for providing elastic force for urging it to the pad 2011 at the backside thereof, and a positioning hook 4001 for fixing the ink jet cartridge IJC to the recording position. The front plate 4000 has two projections 2500 and 2600, and after the mounting of the cartridge, the perpendicular force to the projected surface 4010 is provided. Therefore, a plurality of reinforcing ribs include unshown ribs extending along the perpendicular force direction adjacent the platen roller. The rib constitutes a head protection projection toward the platen roller beyond front position upon the mounting of the cartridge, by approx. 0.1 mm. The electric connection supporting plate 4003 has a plurality of reinforcing ribs 4004 in the direction perpendicular to that of the above-described ribs, so that the degree of lateral projection toward the hook 4001 from the platen side is decreased. This is effective to incline the position upon the mounting of the cartridge. The supporting plate 4003 has a platen Bide positioning surface 4008 and a hook side positioning surface 4007 to stabilize the electric connection to form a pad contact area. Additionally, the amount of deformation of the rubber sheet having projections corresponding to the pad 2011 is determined. When the cartridge IJC is fixed to a position capable of effecting recording operation, the positioning surface is contacted to the surface of the wiring substrate 300. In this embodiment, the pads 201 on the substrate 300 are distributed so as to be symmetrical relative to the line L1, and therefore, the deformation of the projections of the rubber sheet 4006 is made uniform to stabilize the contact pressure relative to the pads 2011 and 201. The distribution of the pads 201 is vertically and horizontally two lines.

The hook 4001 has an elongated opening for engagement with a fixed shaft 4009. Utilizing the moving space of the elongated hole, the hook 4001 is rotated in the counterclockwise direction, and thereafter, it is moved to the left along the platen roller 5000, by which the ink jet cartridge IJC is correctly positioned relative to the carriage HC. The movement of the hook 4001 is not limited, but the use of a lever or the like is preferable. During the rotation of the hook 4001, the cartridge IJC moves toward the platen roller, and the positioning projections 2500 and 2600 are moved to a position contactable to the positioning surface 4010 of the front plate. By the leftward movement of the hook 4001, the 90 degrees hook surface 4002 is closely contacted to the 90 degrees surface of the claw 2100 of the cartridge IJC, and the cartridge IJC is rotated in a horizontal plane about the contact position between the positioning surface 2500 and 4010 to start the contact between the pads 201 and 2011. When the hook 4001 is secured at the predetermined fixed position, the pads 201 and 2011 are completely contacted, and the positioning surfaces 2500 and 4010 are completely contacted, and the contact between the 90 degrees surface 4002 and the 90 degrees surface of the claw are contacted, and in addition, the substrate 300 and the positioning surfaces 4007 and 4008 are contacted, simultaneously, thus completing the mounting of the cartridge IJC on the carriage.

(v) Heater Board

Figure 17:
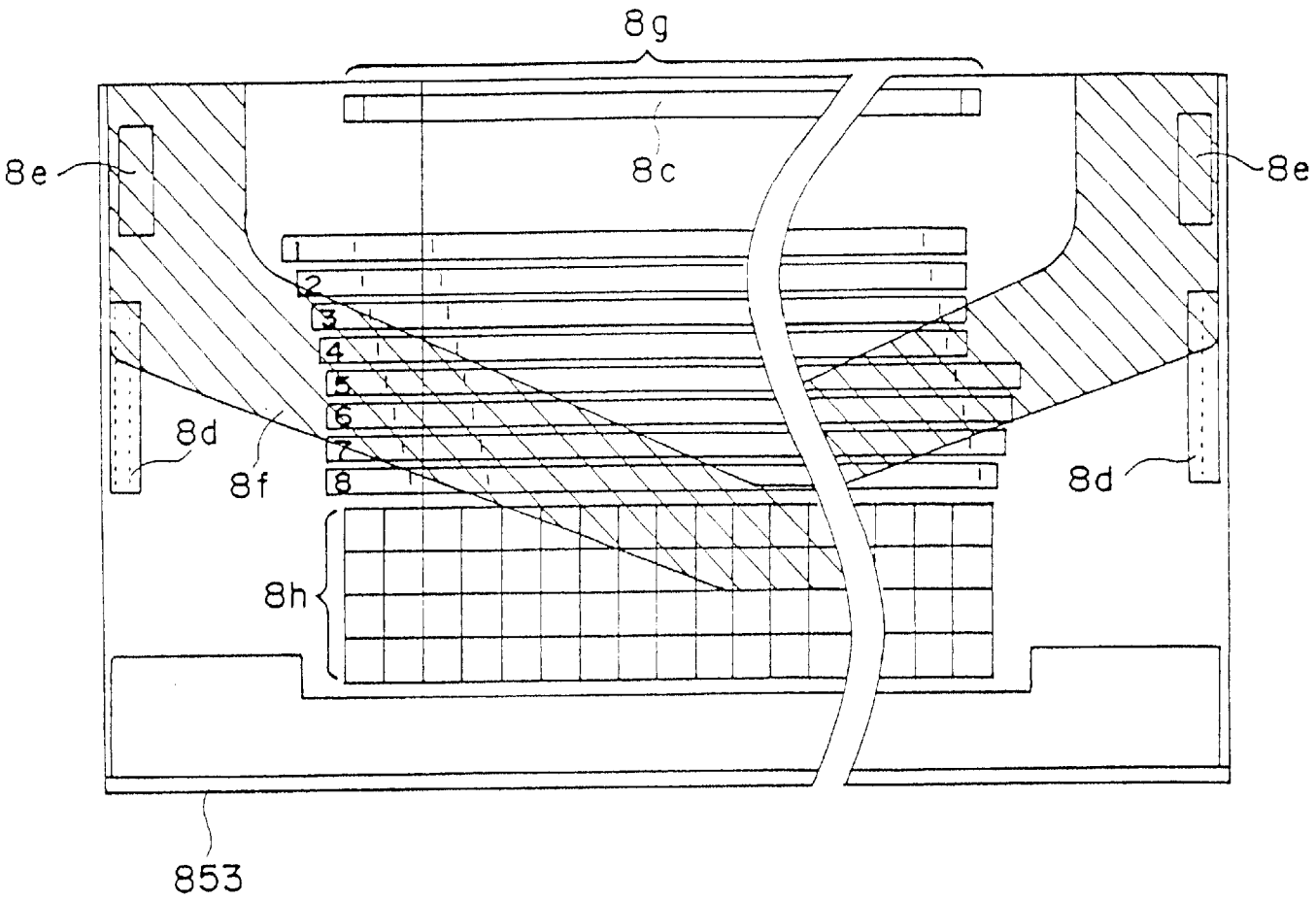
FIG. 17 PRIOR ART
FIG. 17 is a schematic plan view of a substrate constituting the recording head.

FIG. 17 schematically shows the heater board 100 of the head used in this embodiment. There are provided on the same substrate in the relationship Shown in this Figure, a temperature control (subordinate) heater 8*d* for controlling the head temperature, a temperature sensor 8*e* for detecting the head temperature, ejection heater 8*c* for ejecting the ink constituting an array 8*g*, and a driving element 8*h*. In this manner, various elements are disposed on the same substrate so that the head temperature is detected and controlled efficiently. In addition, the head can be downsized, and the manufacturing steps can be simplified. In this Figure, an outer wall cross-section 8*f* of the top plate which is effective to divide the heater board into a region filled with the ink and the region not filled with the ink, is shown. The ejection heater 8*c* side of the wall 8*f* of the top plate functions as a common liquid chamber. By the groove formed on the array 8*g* of the wall 8*f*, liquid passages are formed.

Embodiment 1

Figure 18:
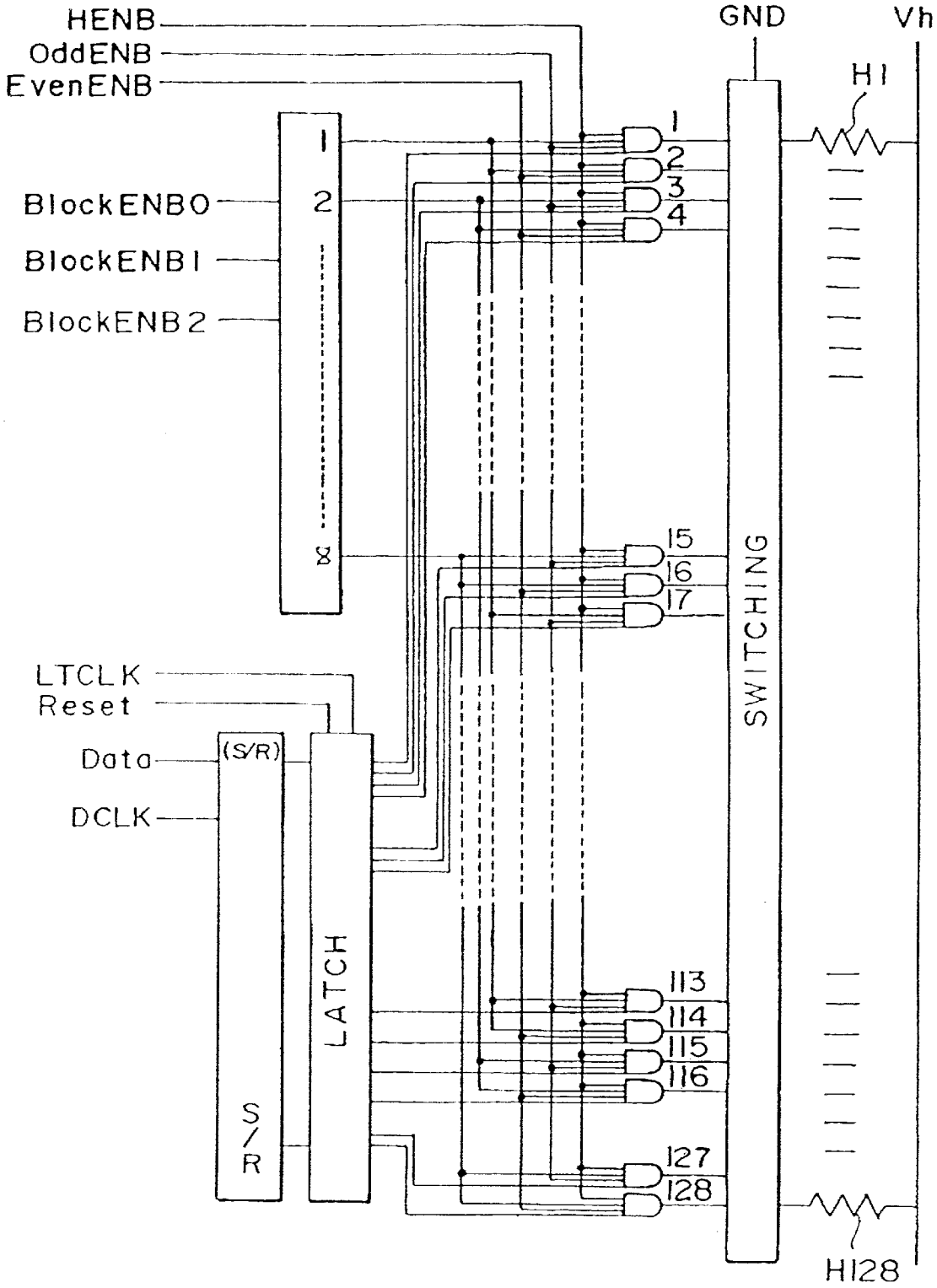
FIG. 18 is a block diagram of a heat driver circuit in the Embodiment.
Figure 29:
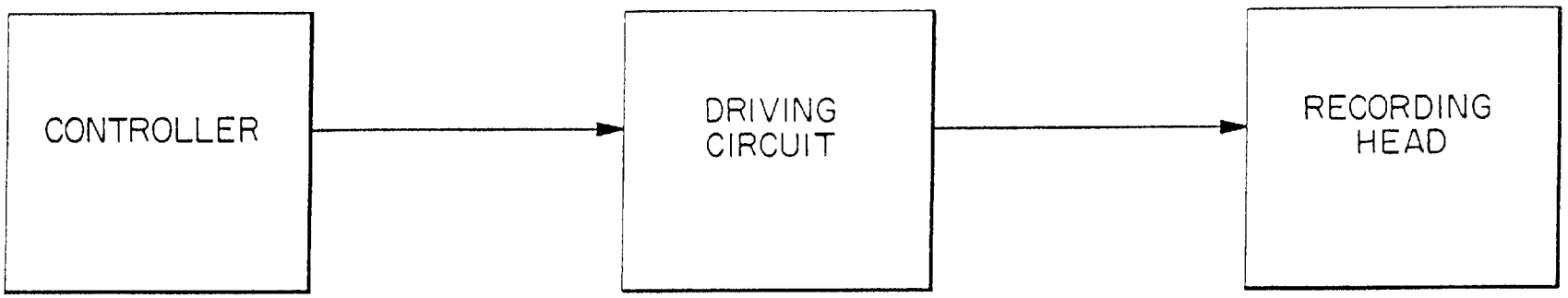
FIG. 29 is a schematic diagram of a control arrangement for the present invention.

In the following description, the total length of the driving pulse is expressed by "Tblock". The total length is mainly determined by the structure and the driving method for the recording head. FIG. 18 shows a driving circuit for the recording head in this embodiment. The driving circuit is controlled by a controller, such as an MPU, to supply driving signals to the recording head as shown in FIG. 29. The head driving circuit, as shown in this Figure, effects divided driving operations for 16 blocks each including 8 ejection outlets of 128 ejection heaters 1–128 of the recording head. For the thus divided 8 blocks, block selection signals are sequentially supplied by combination of three enabling signals BlockENB0, BlockENB1, and BlockENB2. Additionally, selection signals OddENB, EvenENB for selecting odd number heaters and even number heaters, are supplied so that 16 block heaters are sequentially selected. An ejection heater is driven for a period in which an output is produced by AND signal of a signal produced from latch for the block selected by BlockENB0–2 signals and OddENB signal, and EvenENB signal, and HENB signal indicative of the heating period of the ejection heater. The total length of the driving pulse TBlock is determined by a driving frequency, the number of elements to be driven and the number of simultaneously driven elements.

Figure 28R:
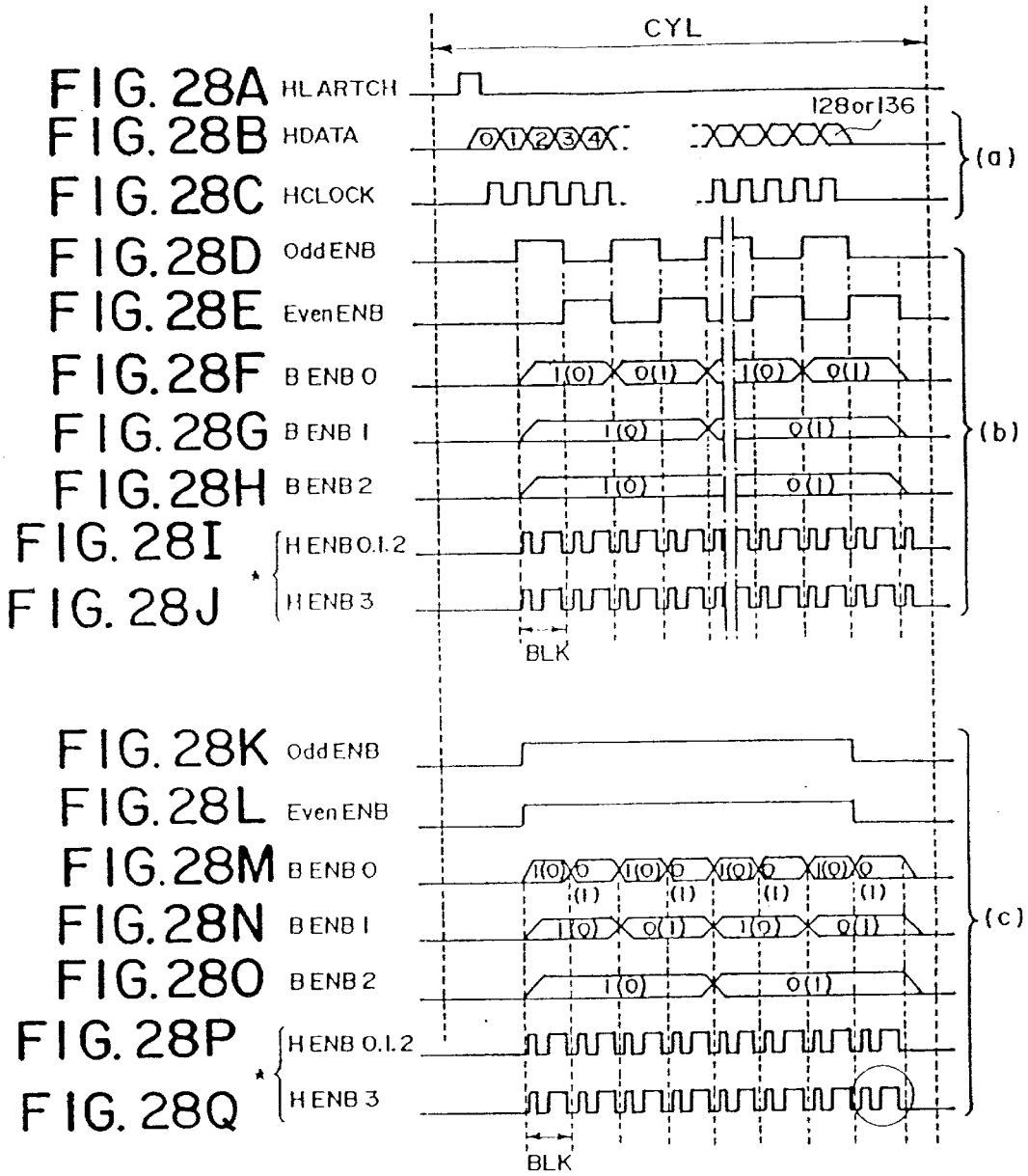
Figure 28R:
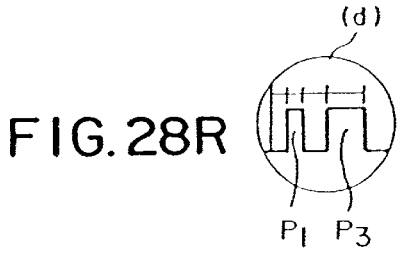

FIG. 28 is a timing chart of various signal transfers in the driving circuit of FIG. 18.

In the Figure, CYL is a time period required for driving all the driving elements, BLK is a time period required for driving one element. In the Figure, (a) shows the signal for data transfer for a shift register.

The head of this embodiment is operated in HQ mode for high quality printing, and a smoothing mode in which smoothing processing is carried out for edge portions of images, and HS mode for high speed printing.

In FIG. 28, (b) shows the timing of transfer of the signal in the HO mode, and (c) is a timing chart for the signal transfer in the HS mode. In the HQ mode, the signals OddENB and EvenENB are alternately produced, whereas in HS mode, the signals OddENB and EvenENB are produced at the same timing. Therefore, in the HS mode, all the driving elements are grouped into 8 blocks, so that the time period required for driving on the elements is shortened, thus permitting high speed printing. The pulse width modulation in the PWM driving method is carried out using HENBO, 1, 2, 3.

Figures 1A, 1B, 1C, 1D:
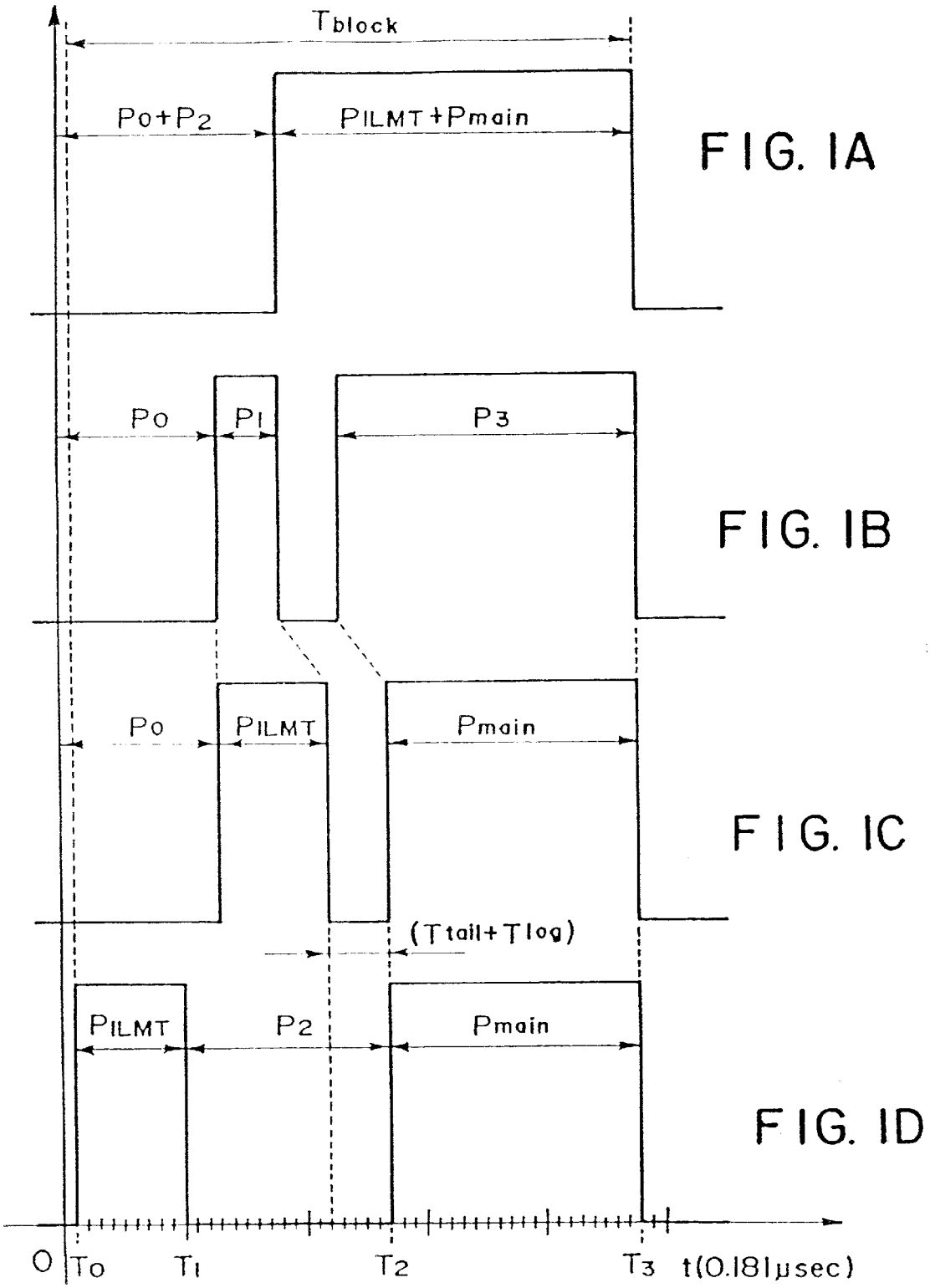
FIGS. 1A and 1B show waveforms of a drive pulse for a recording head according to a first embodiment of the present invention.
Figure 2:
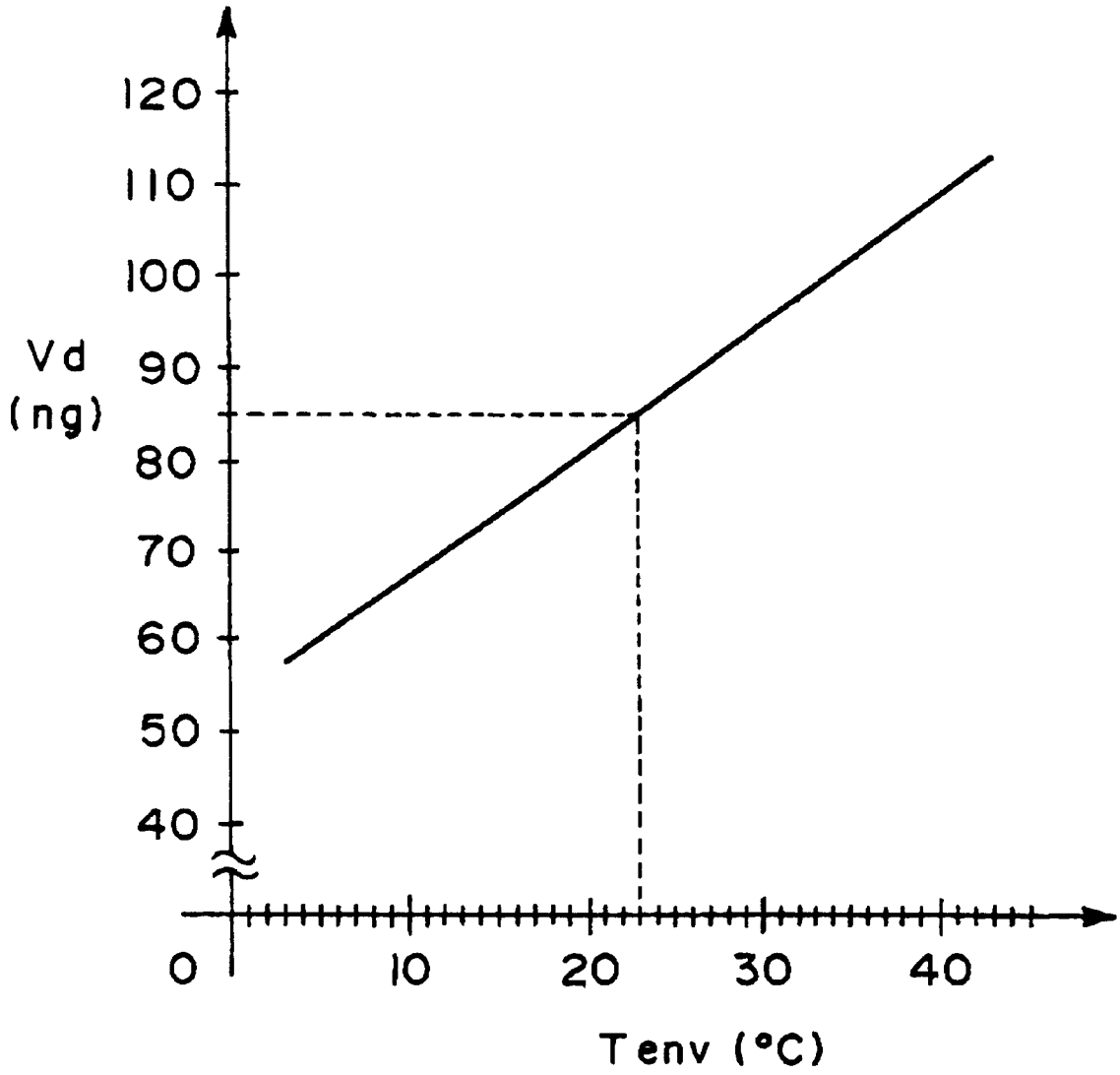
FIG. 2 is a graph showing dependency of ejection amount on ambient temperature.
Figure 3:
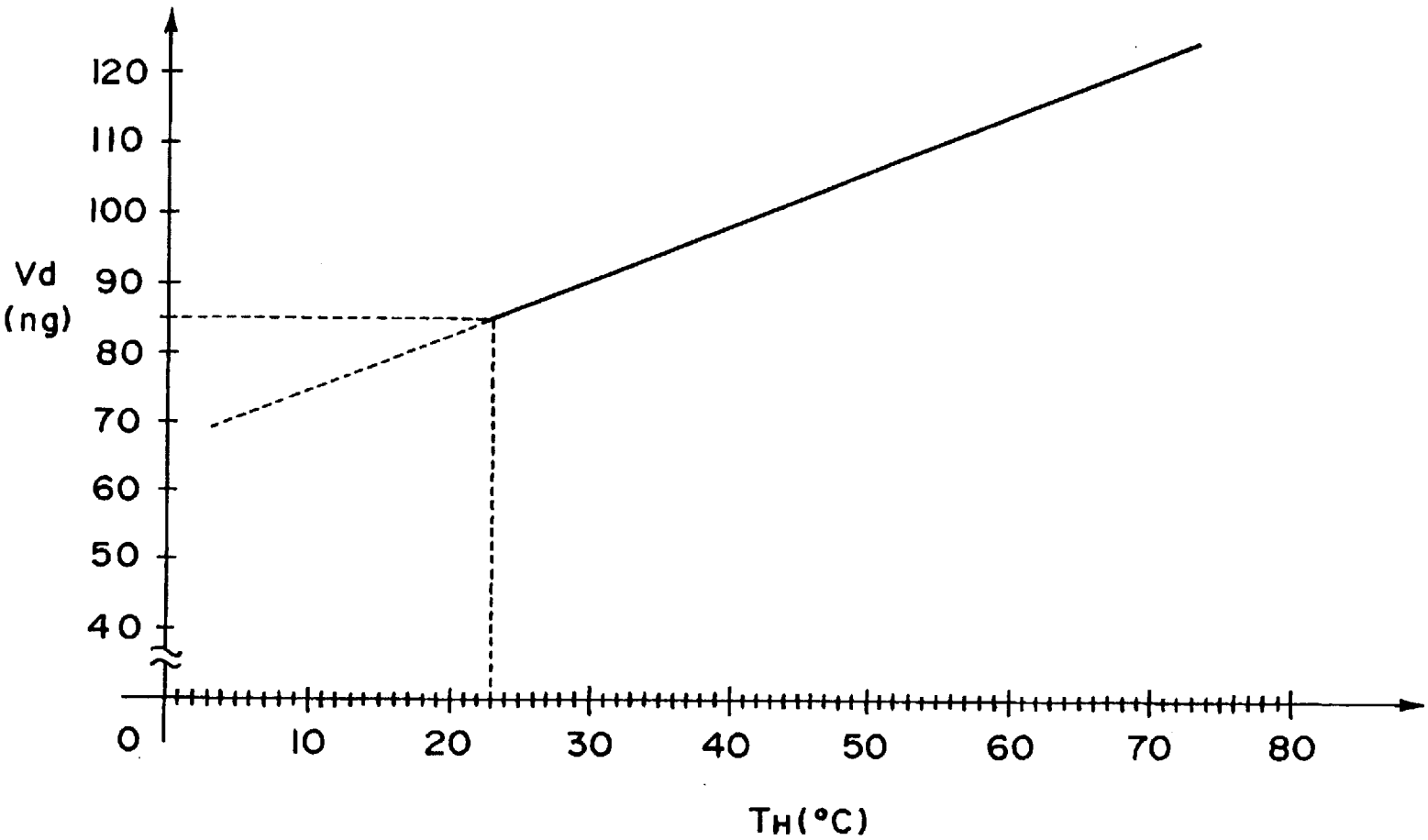
FIG. 3 is a graph showing a dependency of ejection amount on a heat temperature.
Figure 4:
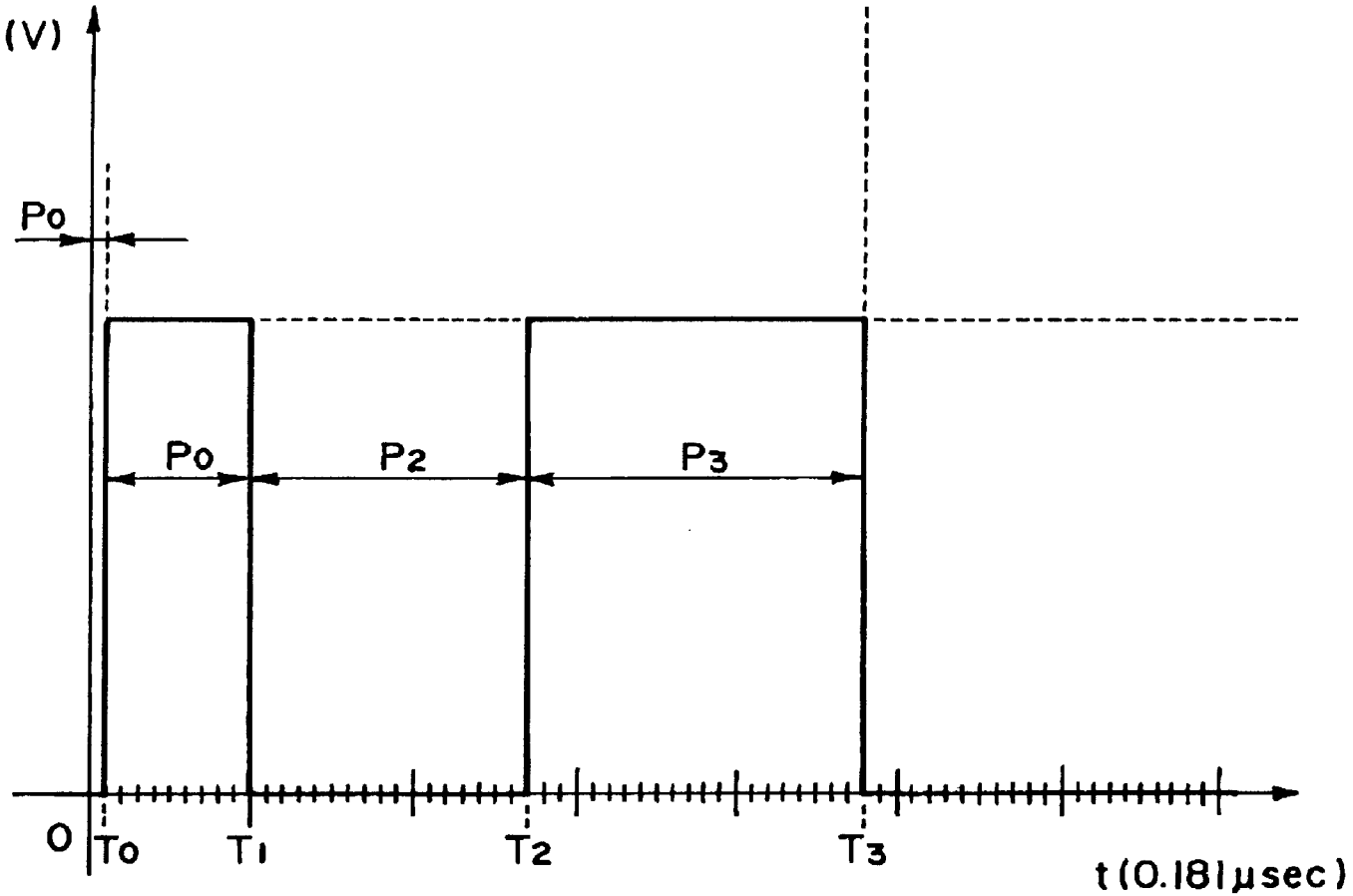
FIG. 4 shows a waveform of a general pulse wave in a PWM drive.
Figure 5:
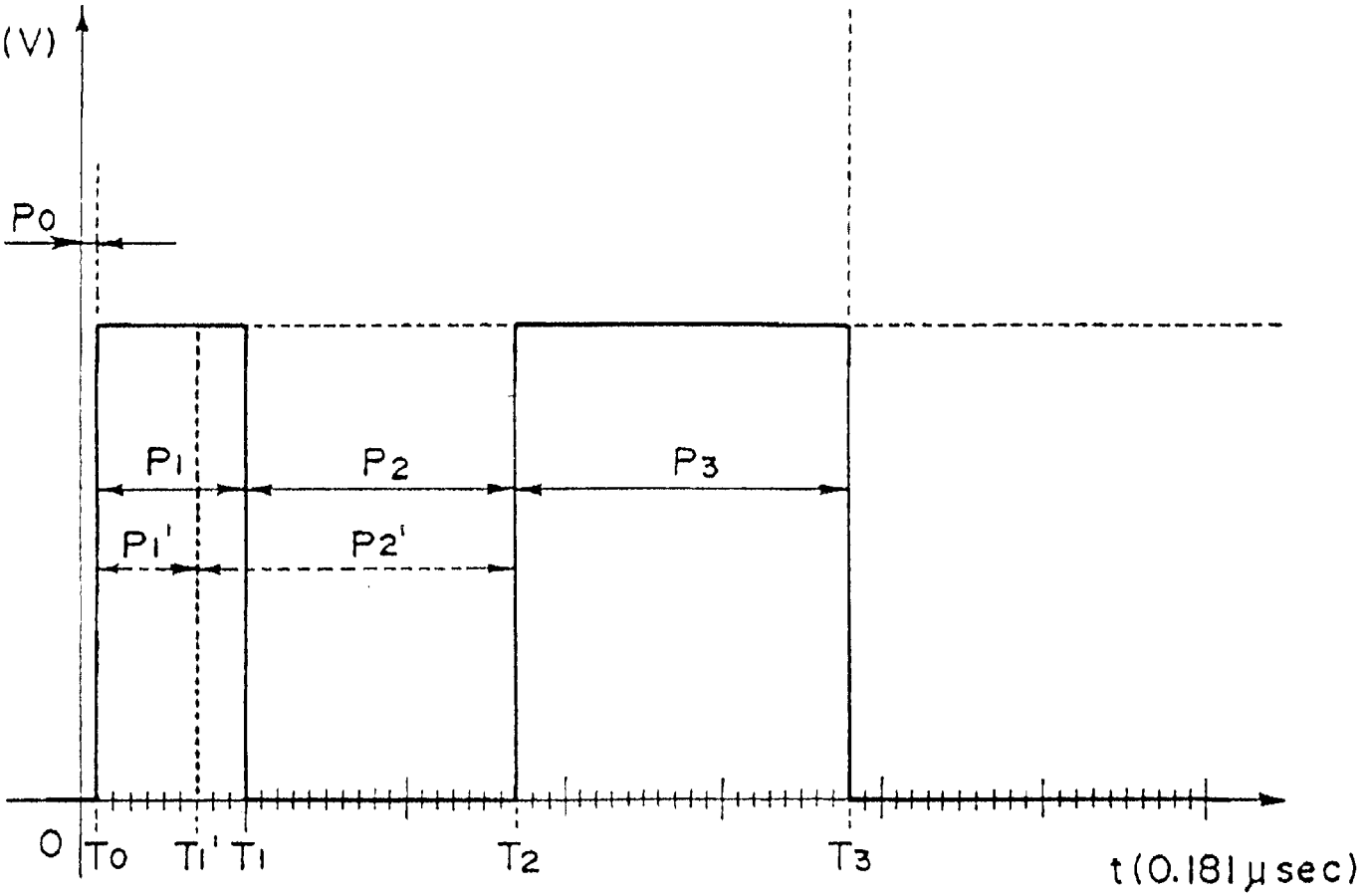
FIG. 5 shows a prepulse control in a PWM drive.
Figure 6:
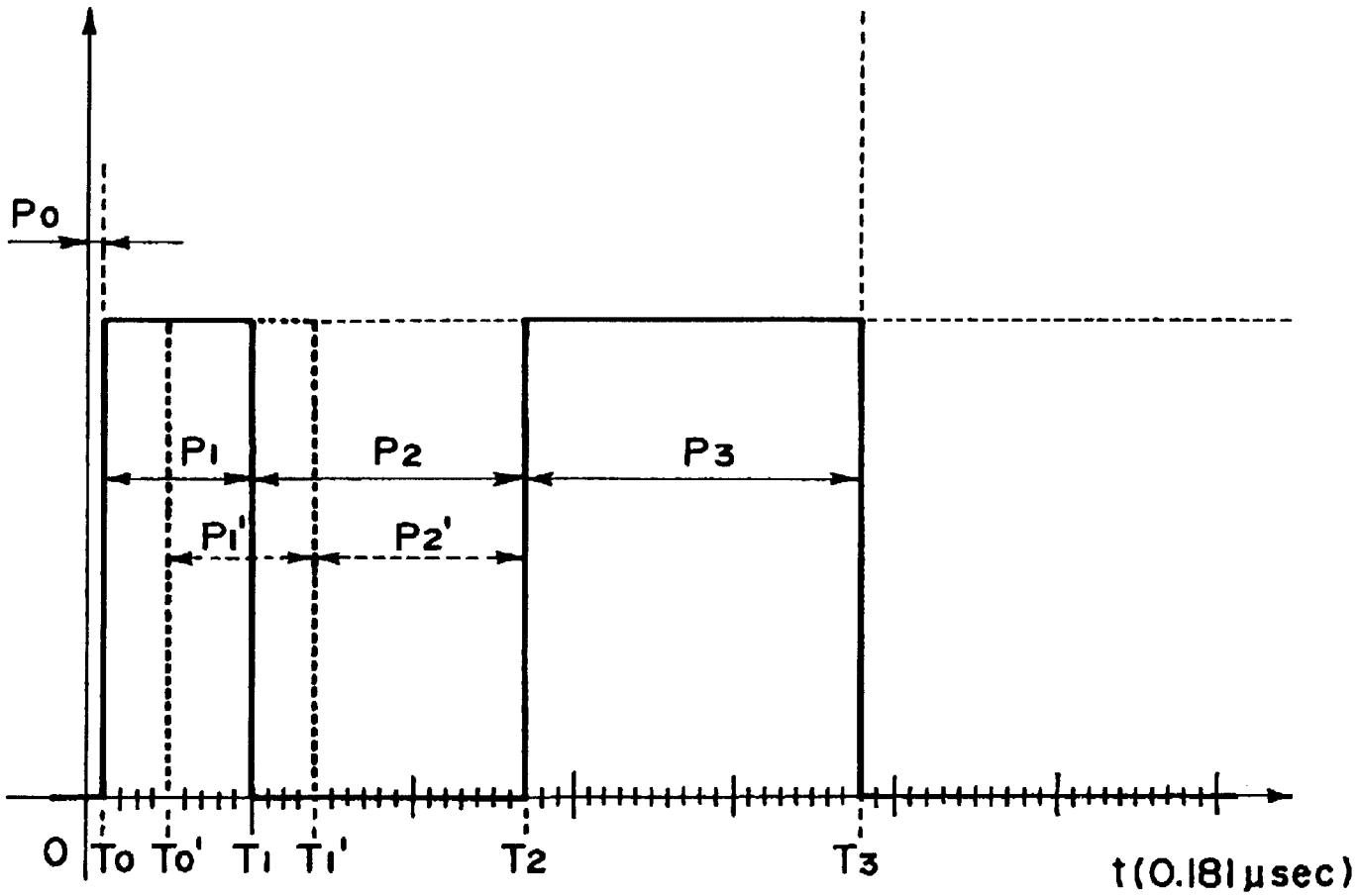
FIG. 6 illustrates an interval time control in a PWM drive.
Figure 7:
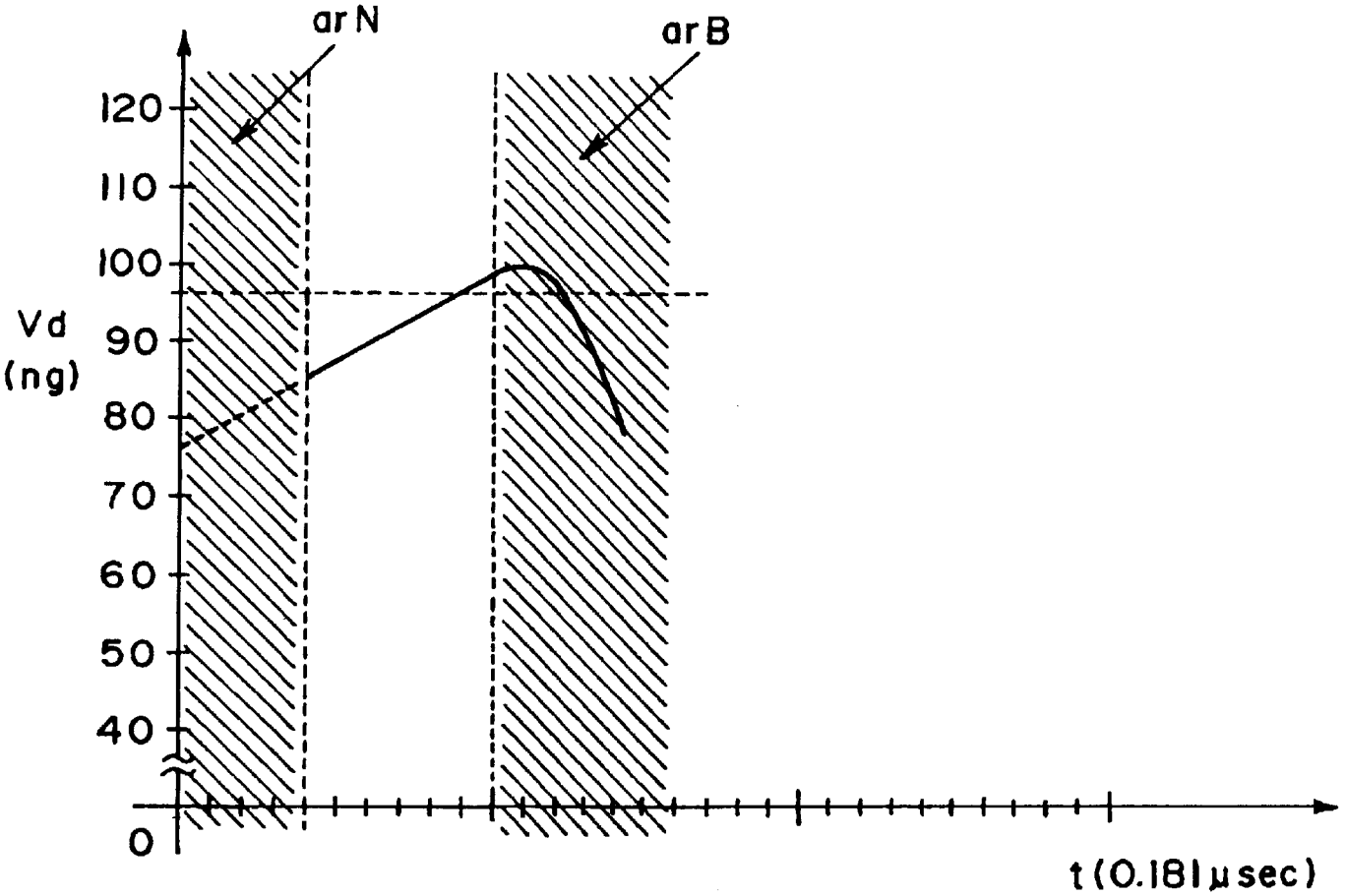
FIG. 7 is a diagram indicating a prepulse dependency of the ejection amount.
Figure 8:
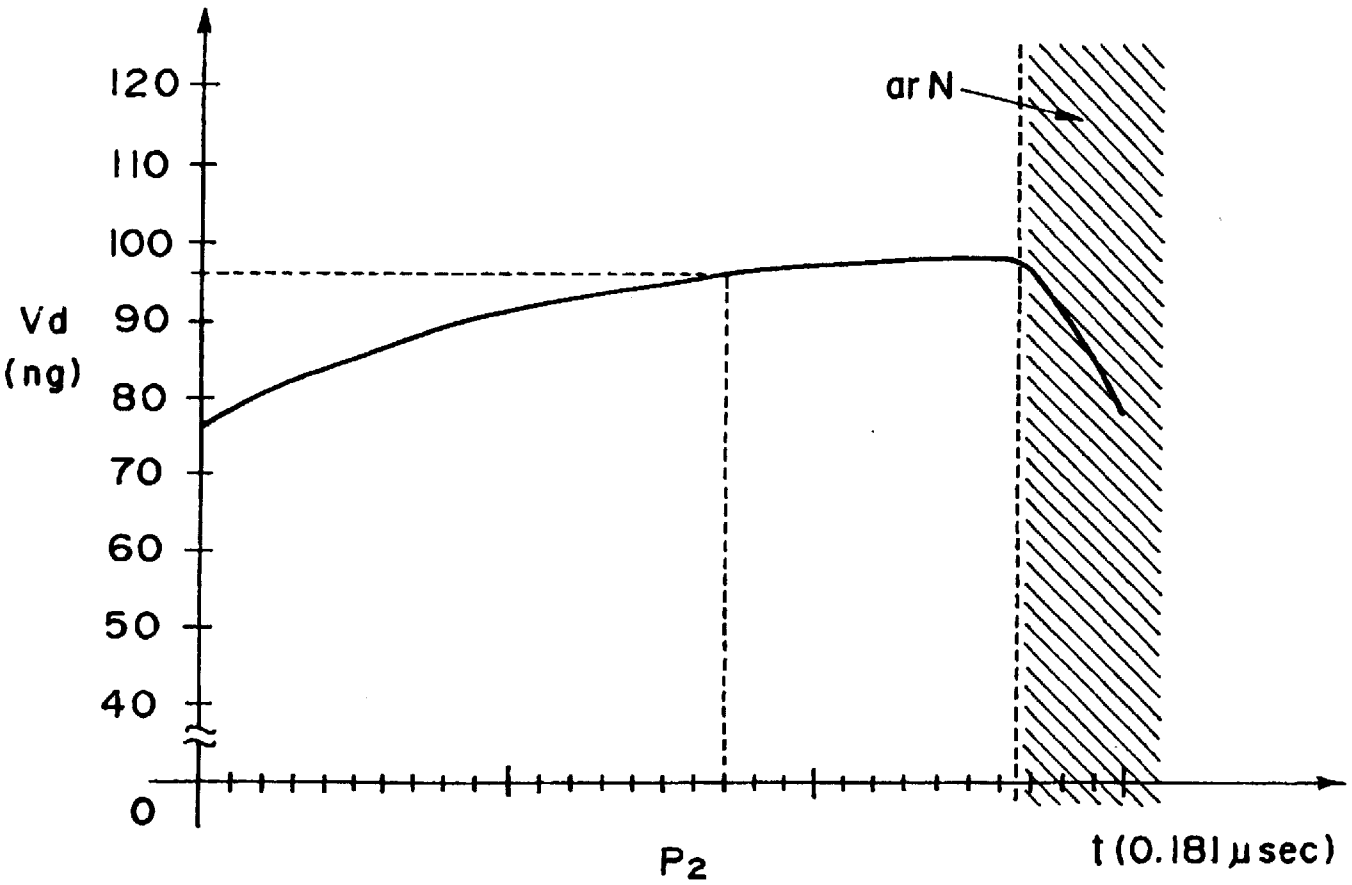
FIG. 8 is a diagram indicating an interval time dependency of ejection amount.
Figure 9:
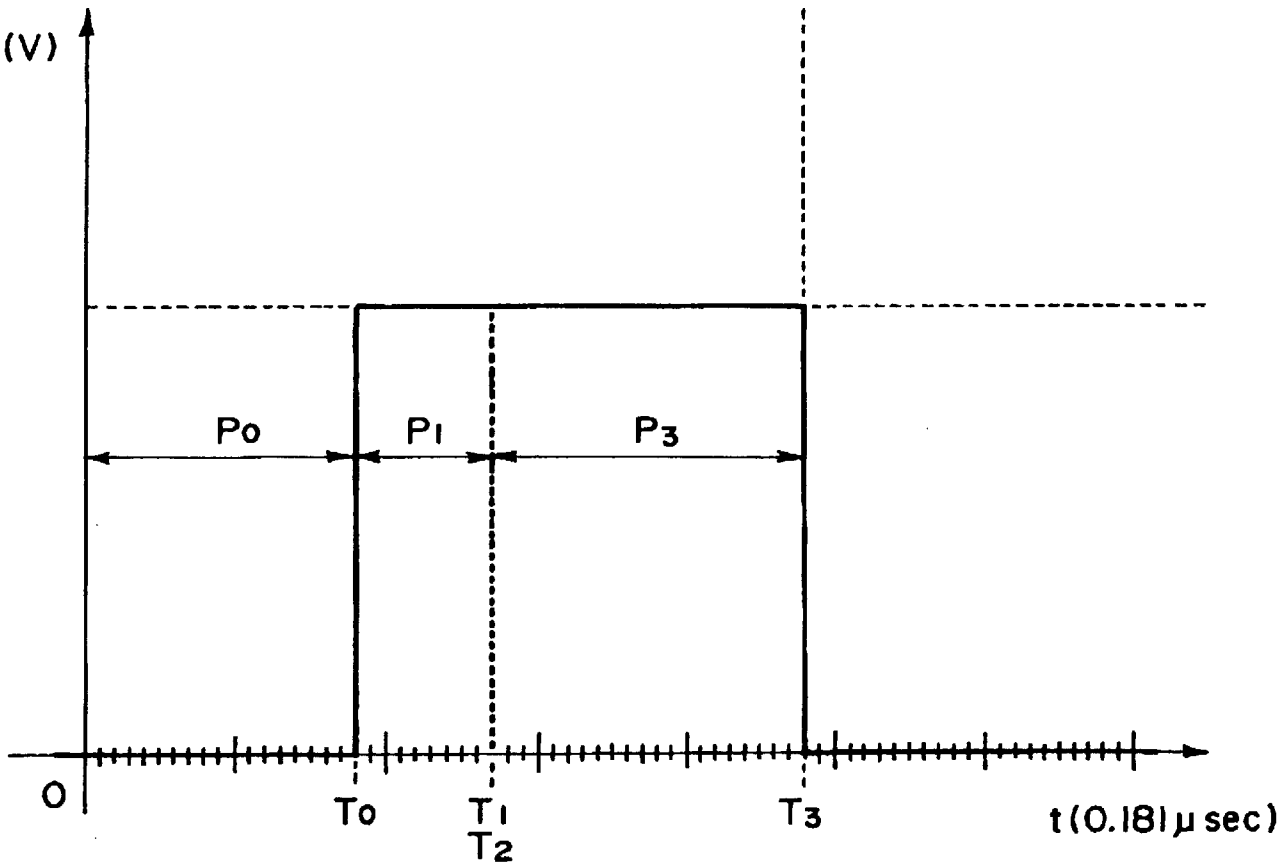
FIG. 9 shows a pulse waveform when the interval period is zero in an interval time control in a PWM driving method.
Figures 10A, 10B:
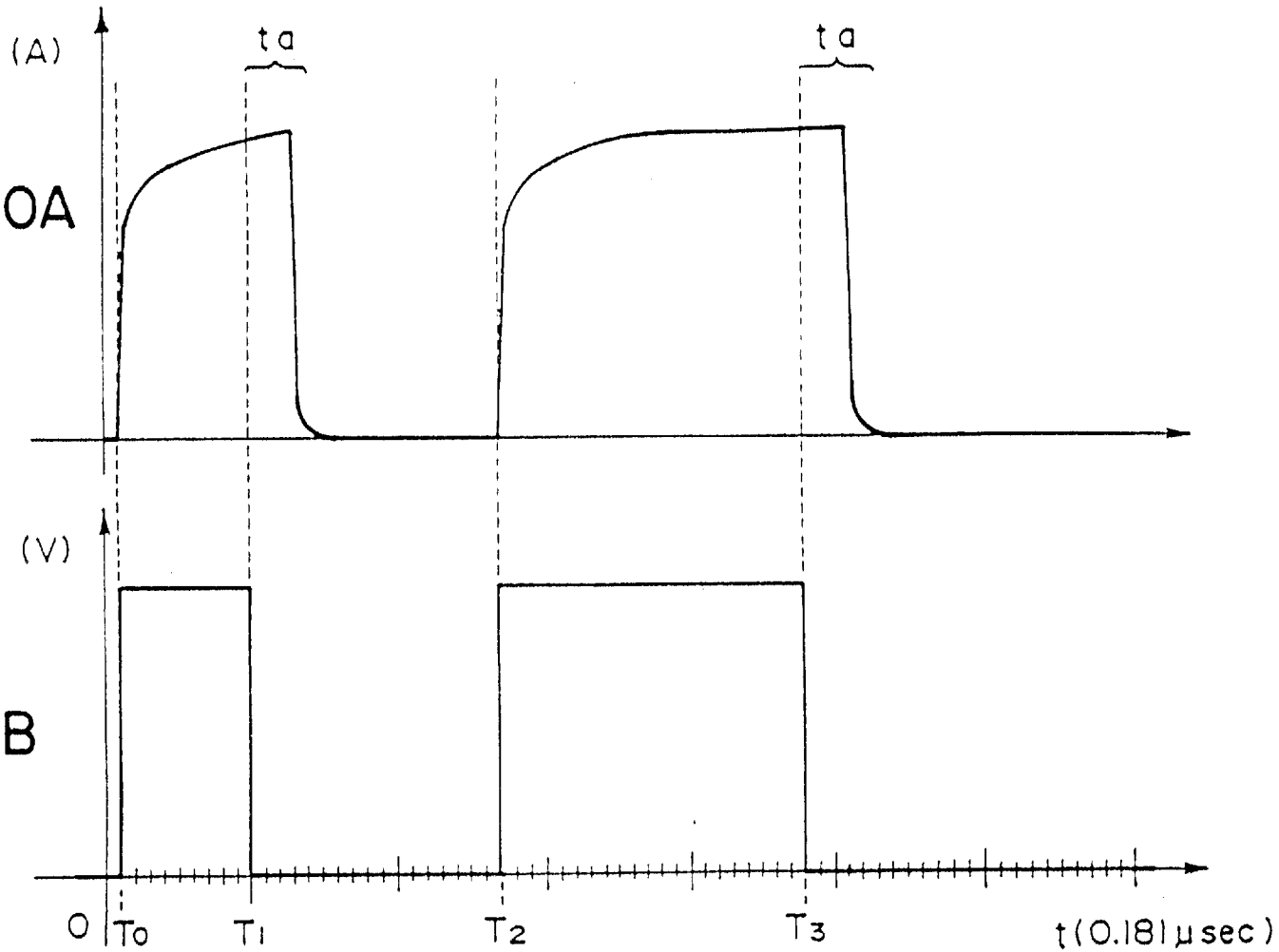
FIGS. 10A and 10B show a driving pulse of PWM drive and a current waveform flowing through the ejection heater.
Figures 11A, 11B:
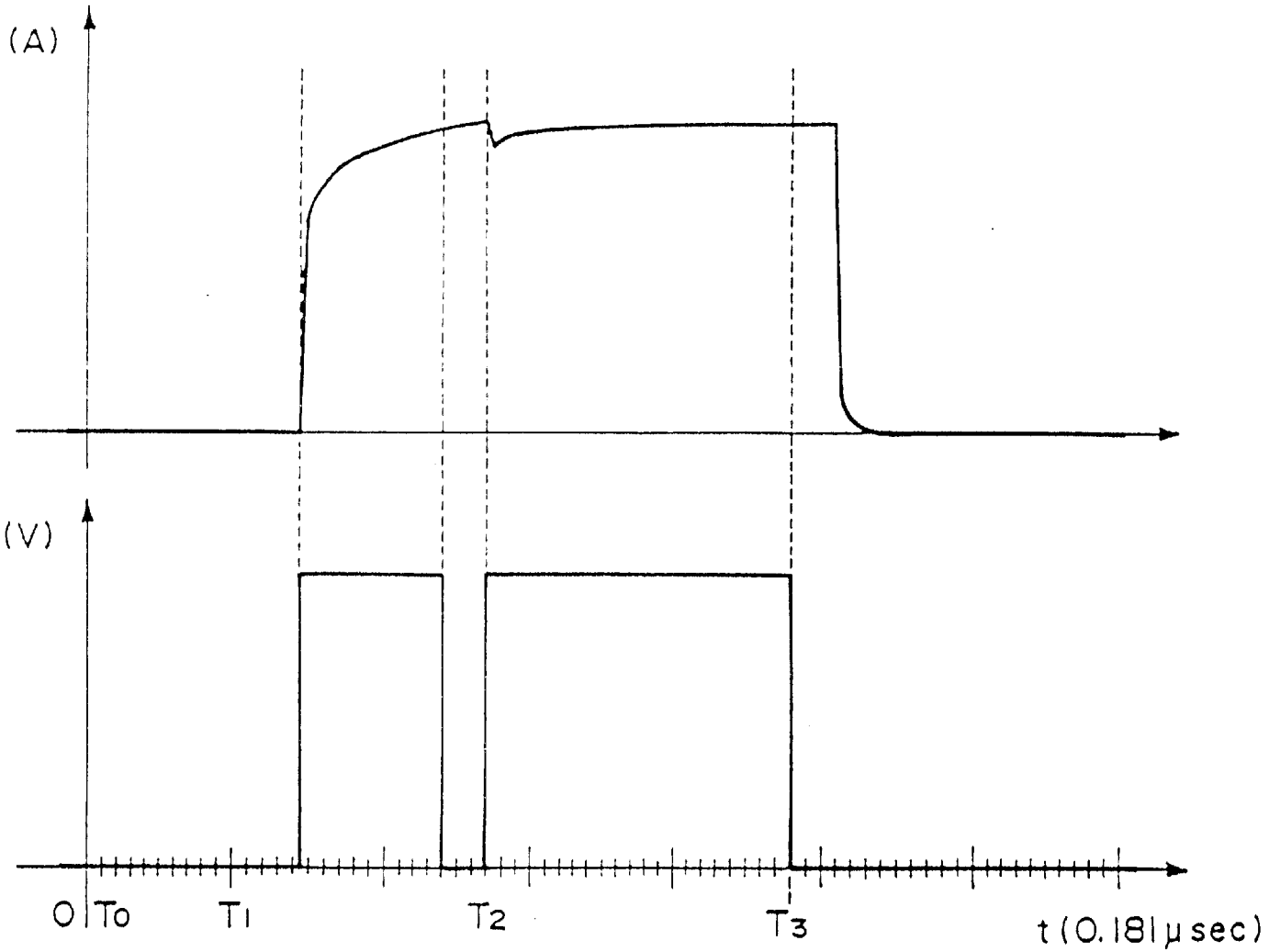
FIGS. 11A and 11B illustrate a problem arising in the current waveform

FIG. 1 illustrates the driving pulse modulating method in this embodiment. In the following explanation, P1LMT is a maximum pulse width not ejecting the ink by the prepulse in the ejection heater drive pulse, Pmain is the main pulse, Tlog is a minimum unit of the pulse width modulation by a logic circuit, and Ttail is a width of a tail of the current pulse waveform by the ejection heater driver.

The driving pulse providing the maximum ejection amount is indicated by D. At this time, the prepulse (or first driving signal) width is P1LMT, the main pulse (or second driving signal) width is Pmain, and the interval (or rest period) time is (Tblock−P1LMT−Pmain).

When the amount of ejection is larger than required because of tho head temperature or the ambient temperature increase, the pulse wave is modulated sequentially to the pulse indicated by C. More particularly, the prepulse width P1LMT is not changed, but the interval time P2 is gradually decreased by Tlog from the initial width P2 to (Ttail+Tlog).

When the head temperature or the ambient temperature is further increased, the waveform is modulated from C to A through B. The interval time P2 can not be made shorter than (Ttail+Tlog) in consideration of the width Ttail. For this reason, when the pulse waveform is modulated from C to A through B, the interval time P2 is fixed at (Ttail+Tlog), and the prepulse width P1 is decreased from P1LMT to 0 by Tlog gradually, so that in synchronism with the decrease of the width of the prepulse P1, the main pulse P3 is increased to (P1LMT+Pmain) by the width of Tlog.

As described in the foregoing, when the interval time is reduced, the minimum time is the tail width Ttail plus minimum modulation width Tlog, so that the prepulse and the main pulse are prevented from combining with each other into a single pulse. As a result, the ejection amount or quantity control can be carried out with the advantage of the divided pulse drive.

FIG. 19 shows a driving pulse table used in the driving system.

As described hereinbefore, the total width of the driving pulse is determined by the structure of the recording head and the driving method. The recording head of this embodiment, as described in conjunction with FIG. 18, has 128 ejection outlets, which are divided into 18 blocks each having 8 ejection outlets. The maximum simultaneous driven ejection outlets are 8 ejection outlets, and the period of the ejections is 160 μsec. The total pulse width is Tblock (P0+P1+P2+P3) is 48st (1st=0.181 μsec) (P1≧1st). The total width of the optimum prepulse and the main pulse (P1+P3) is determined by the structure of the heat generating element and the driving voltage or the like, and it is 30st in the case of the head of this embodiment.

In the table shown in FIG. 19, the modulations PWM No. 23–PWM No. 10, correspond to one changing region including modulations from pulse D to pulse C, and the modulations PWM No. 10–PWM No. 1 corresponds to another changing region including the modulation from pulse C to pulse A through pulse B.

Figure 20:
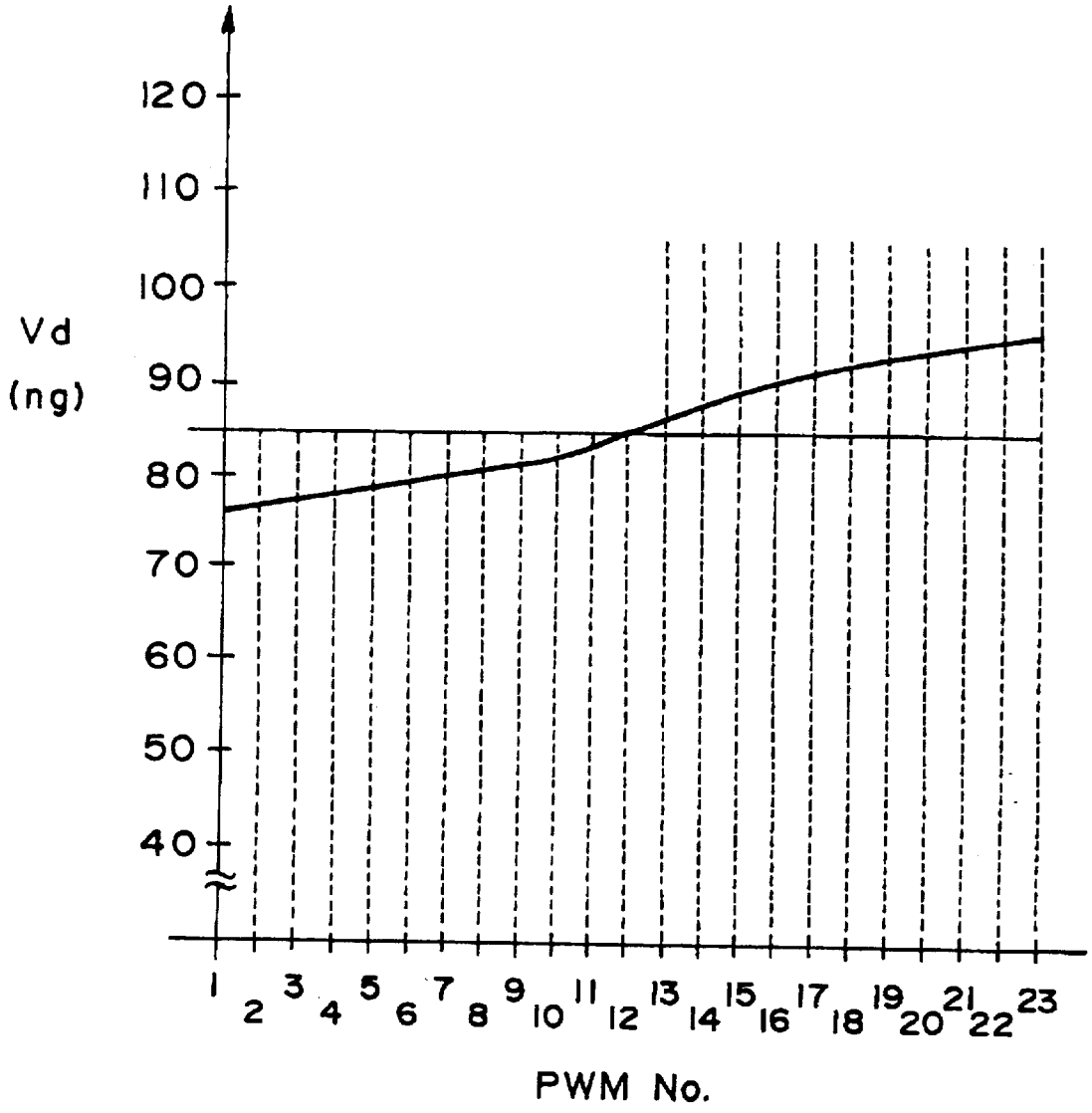
FIG. 20 a diagram showing a relationship between a PWM number and ejection amount in the PWM table.

FIG. 20 is a diagram showing ejection amount by each PWM drive pulse of FIG. 19 when the ambient temperature is 23° C. and the head temperature is 23° C.

As shown in the Figure, the ejection amount is suppressed with the driving pulse having smaller PWM No., whereas the driving pulse having a larger PWM No. increases the ejection amount. On the basis of this, assuming that the target ejection amount of the ejection amount control in this embodiment is 85 ng/drop, the PWM number selected on the basis of the excessiveness or shortage of the ejection amount is determined, and the PWM selection table shown in FIG. 21 is selected.

The ambient temperature dependency coefficient in this embodiment Kenv is 1.4 (ng/° C. drop), and the head temperature dependency coefficient KH is 0.8 (ng/° C. drop).

Figure 22:
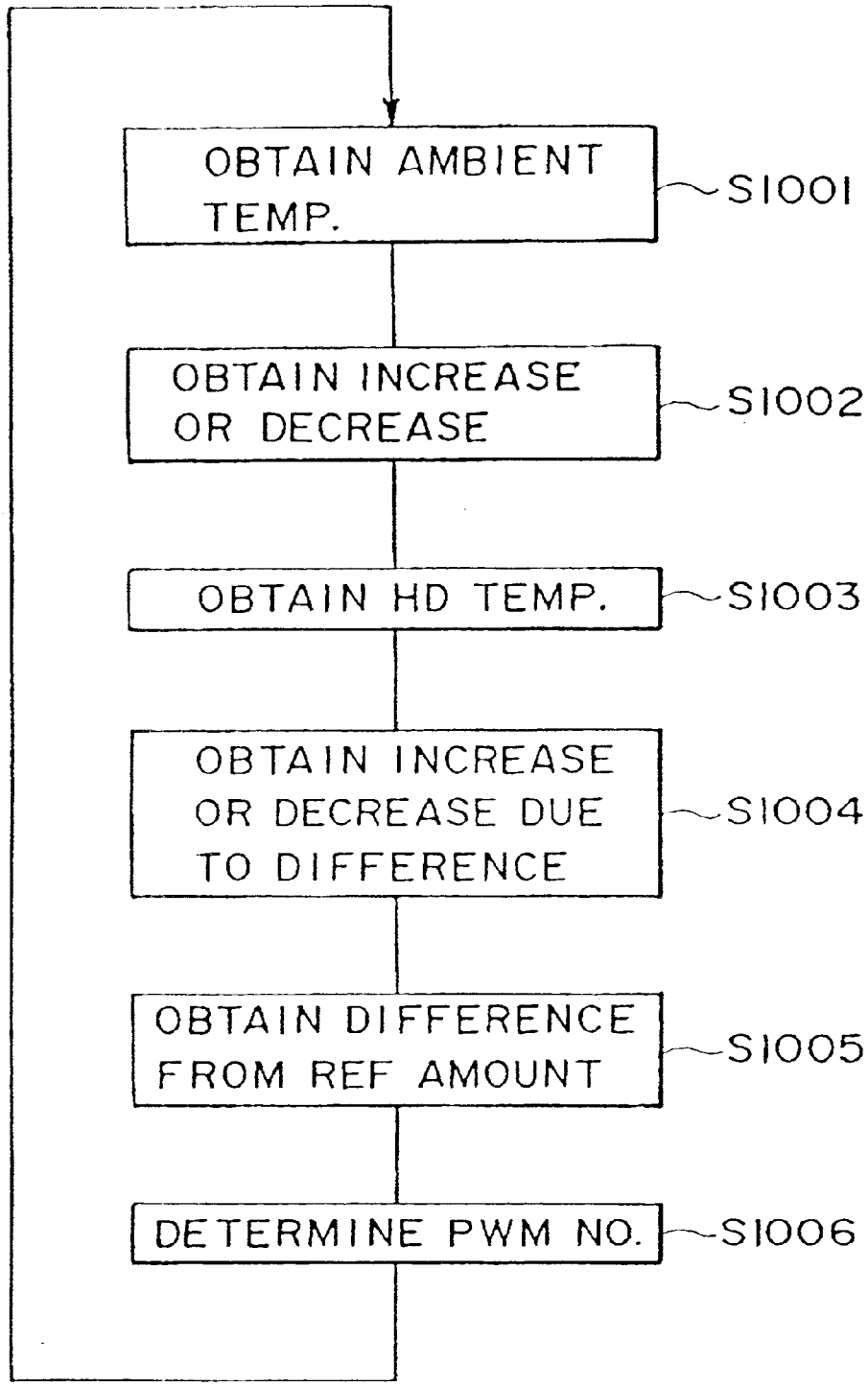
FIG. 22 is a flow chart for the selection of the PWM number.

Referring to FIG. 22, the description will be made as to the actual head driving method using the PWM table shown in FIGS. 19 and 21.

At step S1001, the ambient temperature of the recording head is fetched. In step S1002, the increase or decrease dV1 of the ejection amount due to the ambient temperature obtained at step S1001 is determined by the following equation:

$$dV1=Kenv\times(Tenv-23^\circ\ C.) \quad (1)$$

At step S1003, the head temperature TH is fetched, and at step S1004, the increase or decrease dV2 of the ejection amount by the head temperature increase is determined by the following equation:

$$dV2=KH\times(TH-Tenv) \quad (2)$$

At step S1005, excessiveness or shortage dV from reference ejection amount, of the ejection amount varied due to the ambient temperature Tenv, head temperature TH or the like, is determined using the following equation:

$$dV=dV1+dV2 \quad (3)$$

At step S1006, the PWM number is determined referring to the table shown in FIG. 21 on the basis of the difference dV of the ejection amount determined by the equation (3). From the PWM No. fetched at step S1006, the pulse waveform for the head drive is determined, referring to the table of FIG. 19. In this embodiment, the tail of the current width of the head driving pulse Ttail is deemed as 3st, and on the basis of this, the waveform of the PWM drive is modulated. When the PWM drive using the conventional interval time control is carried out on the assumption that the Ttail is 3st, the number of control steps for the modulation is 14 steps.

According to this embodiment, the consideration is paid to the dullness Ttail of the pulse current. In the range in which the advantages of the divided pulse in the PWM driving method is provided by the interval time P2, the interval time P2 is controlled, and outside the range, the width of the prepulse P1 is controlled to effect the modulation. Therefore, smoother pulse width modulation than the conventional is accomplished. On the basis of the ambient temperature and the head temperature, the difference of the ejection amount from the reference amount is obtained, on the basis of the difference, the driving pulse waveform is determined, so that correct ejection amount control and high quality print are accomplished.

Embodiment 2

As another embodiment, the description will be made as to the PWM driving method in which the method is switched depending on the range of the head temperature. The structure and function of the recording apparatus and recording head are the some as with Embodiment 1, and the detailed description thereof is omitted for simplicity.

The recording head of this embodiment has ejection heaters through film forming process, and therefore, the configuration in the direction of the surface of the heater board, that is, the area can be relatively accurately controlled, but there is a higher liability that the thicknesses vary. For this reason, when the thicknesses of the ejection heater are not constant, the amount of heat generations are different if the driving voltages and the driving pulses are the same, respectively. Therefore, in this embodiment, the width or the voltage of the driving pulse is properly set in accordance with the heat generation amount.

However, when the pulse width is selected to the proper level, there arises a problem, although the problem does not arise when the voltage is set properly in the structure as in Embodiment 1. The recording heads are classified into 13 ranks (head ranks) depending on the heat generating amount of the ejection heaters thereof. If the attempt is made to set the pulse widths to the proper levels for the respective ranks, P1LMT and Pmain are as shown in FIG. 23. Thus, the P1LMT changes depending on the rank of the head, and therefore, the usable range for the ejection amount by the change of P1 (the range indicated by the PWM number as in FIG. 19) is different. This means that the head temperature range for the switching of the PWM drive is different.

Therefore, in this embodiment, a proper PWM table is provided corresponding to the head rank, so that the temperature range for the PWM drive switching is made constant.

FIG. 24 is a PWM table when P1LMT is 9st, FIG. 25 is a PWM table when PlLMT is 8st, FIG. 26 is a PWM table when P1LMT is 7st, and FIG. 27 is a PWM table when P1LMT is 6st.

That is, when the head rank is 12 or 13 shown in FIG. 24, the table of FIG. 24 is used to determine the waveform for the PWM drive. Similarly, referring to a table corresponding to P1LMT for the head rank, The waveform of the PWM control is determined, by which the temperature range for the control switching is constant, and therefore, the ejection amount can be made constant despite the difference in the ejection performance of the individual recording heads.

As shown in FIGS. 24–27, if the total of the pulse widths of the driving pulse namely the total of P1LMT and Pmain is decreased, the maximum width of the interval time can be increased, correspondingly. Then, the decrease of the control step due to P1 can be compensated for by the increase of the control steps by P2.

Another Embodiment

When the driving period for the recording head is decreased by switching, the total length (P0+P1+P2+P3) of the driving pulse width is limited. Therefore, the PWM tables used in the foregoing embodiments, are unable to be used, as they are.

Therefore, the decrease of the total length of the pulse due to the switching of the driving condition on the basis of the total length (P0+P1+P2+P3) of the pulse in each of the embodiments, is determined. The difference of P0 in the PWM table in each of the embodiments from the decrease is used as a new P0. Here, the PWM No. which is smaller than 1 may be produced. Therefore, the upper limit is set corresponding to the PWM number for P0−1 upon the PWM selection, thus limiting the PWM selection table, so that the table having the PWM number larger than the PWM number corresponding to P0=1.

By doing so, even if the change of the driving condition which limits the total length of the pulse (P0+P1+P2+P3), occurs, the PWM tables in the foregoing embodiments are usable.

As described in the foregoing, according to this invention, even if the current flowing through the recording element or electrothermal transducer element has a waveform including tail or trail relative to the driving pulse, because of the property of the head driving means, the minimum of the driving pulse rest period can be made longer than the tail period, so that the effective number of steps usable for the pulse width modulation can be maintained, thus accomplishing smooth ejection amount control.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558.333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head or plural recording heads combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressurizing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single head corresponding to a single color ink, or may be plural heads corresponding to the plurality of ink materials having different recording colors or densities. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is applied. The present invention is applicable to other types of ink. In one of them, the temperature rise due to the thermal energy is positively prevented by consuming it for the state change of the ink from the solid state to the liquid state. Another ink material is solidified when it is left unused, to prevent the evaporation of the ink. In either of the cases, upon the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

These and other objects, features and advantages of the present invention will become more apparent upon a consideration of the following description of the preferred embodiments of the present invention taken in conjunction with the accompanying drawings.

What is claimed is:

1. An ink jet recording apparatus in which thermal energy is applied to ink in accordance with driving signals applied to a heater of a recording head to produce a bubble, by which the ink is ejected onto a recording material, said apparatus comprising:

driving means for applying a plurality of the driving signals to the heater for ejection of one ink droplet, wherein the driving signals comprise a first driving signal not ejecting the ink and a second driving signal for ejecting the ink, the second driving signal being applied after a rest period after the first driving signal, each of the first and second driving signals and the rest period having a length; and pulse width modulating means operable in first and second changing regions for controlling an ejection amount of ink by changing at least one of the length of the rest period and the length of the first driving signal applied by said driving means, wherein said modulating means effects its changing operation in the first changing region in which the length of the rest period is changed without changing the length of the first driving signal and in the second changing region in which the length of the first driving signal is changed without changing the length of the rest period, and wherein control of the ejection amount in the first changing region is such that the ejection amount is larger than the ejection amount in the second changing region.

2. An apparatus according to claim 1, wherein in the first changing region, a minimum of the length of the rest period is determined based on a deviation between a current waveform in the heater caused by application of one of the driving signals and a pulse waveform of the one driving signal.

3. An apparatus according to claim 1, wherein in the first changing region, the length of the first driving signal is insufficient to eject the ink.

4. An apparatus according to claim 1, further comprising ambient temperature detecting means for detecting a temperature of ambience of the recording head, and head temperature detecting means for detecting a temperature of the recording head, wherein said modulating means determines the lengths of the first driving signal and the rest period.

5. An apparatus according to claim 4, wherein said modulating means effects its changing operation in the first changing region when a recording head temperature region based on outputs of said ambient temperature and head temperature detecting means is relatively low.

6. An apparatus according to claim 1, further comprising storing means for storing information for changing the first driving signal and the rest period, wherein said modulating means determines the lengths of the first driving signal and the rest period based on information stored in said storing means.

7. An apparatus according to claim 6, wherein the information corresponds to the first driving signal and the rest period determined for each of ejection amount ranges.

8. An apparatus according to claim 6, wherein said storing means includes a table for determining the lengths of the first driving signal, the second driving signal, and the rest period.

9. An apparatus according to claim 8, wherein said storing means includes a plurality of tables corresponding to characteristics of the recording head.

10. An apparatus according to claim 1, wherein a minimum length of the rest period is determined based on a deviation between a waveform of a current supplied to the heater by the first driving signal and a waveform of the first driving signal.

11. An ink jet recording method in which ink is supplied with thermal energy in accordance with driving signals applied to a heater to produce a bubble, by which the ink is ejected onto a recording material, and wherein a plurality of the driving signals for one droplet ink ejection are applied, said method comprising the steps of:

supplying a first driving signal, having a length, to cause the heater to generate heat insufficient to eject the ink;

providing a rest period, having a length, after said first driving signal supplying step;

supplying a second driving signal to produce a bubble in the ink to eject the ink; and controlling an ejection amount of the ink by changing at least one of the length of the first driving signal and the length of the rest period, wherein said controlling step effects the changing in a first changing region in which the length of the rest period is changed without changing the length of the first driving signal and in a second changing region in which the length of the first driving signal is changed without changing the length of the rest period, and wherein control of the ejection amount in the first changing region is such that the ejection amount is larger than the ejection amount in the second changing region.

12. A method according to claim 11, further comprising the steps of detecting a temperature of ambience of the recording head, and detecting a temperature of the recording head, wherein said controlling step determines the lengths of the first driving signal and the rest period.

13. A method according to claim 12, wherein said controlling step effects the changing in the first changing region when a recording head temperature region based on the ambient and head temperatures is relatively low.

14. A method according to claim 11, wherein said controlling step changes the first driving signal and the rest period based on a table determining information relating to lengths of the first driving signal and the rest period.

15. An ink jet recording apparatus wherein recording is effected by ejecting ink from an ink jet recording head onto a recording material by driving an electrothermal transducer in the ink jet recording head, said apparatus comprising:

driving means for applying a plurality of driving pulses to the electrothermal transducer of the ink jet recording head for ejection of one ink droplet, wherein the driving pulses comprise a first driving pulse not ejecting the ink and a second driving pulse for ejecting the ink, the second driving pulse being applied after a rest period after the first driving pulse; and modulating means for modulating each pulse width of the driving pulses supplied by said driving means and the rest period, wherein a minimum of the modulated rest period is limited, the minimum of the length of the rest period is determined such that a current waveform in the electrothermal transducer caused by application of the first driving pulse does not combine with a current waveform caused by application of the second driving pulse.

16. An apparatus according to claim 15, wherein the electrothermal transducer includes a heater which generates thermal energy, and the ink jet recording head applies the thermal energy to the ink to generate a bubble to eject the ink.

17. An apparatus according to claim 15, wherein the electrothermal transducer includes a heater which generates thermal energy, and the ink jet recording head applies the thermal energy to the ink to generate a bubble to eject the ink.

18. An apparatus according to claim 15, further comprising temperature detecting means for detecting a temperature of the recording head, and control means for modulating pulses applied to the electrothermal transducer, using said modulating means based on a result of detection by said temperature detecting means.

19. An apparatus according to claim 15, wherein the first driving signal is modulatable within a changing region, and in the changing region, the length of the first driving pulse is insufficient to eject the ink.

20. An apparatus according to claim 15, further comprising storing means for storing information for changing the first driving pulse and the rest period, wherein said modulating means determines the lengths of the first driving pulse and the rest period based on information stored in said storing means.

21. An apparatus according to claim 20, wherein the information corresponds to the first driving pulse and the rest period determined for each of ejection amount ranges.

22. An apparatus according to claim 20, wherein said storing means includes a table for determining the lengths of the first driving pulse, the second driving pulse, and the rest period.

23. An apparatus according to claim 22, wherein said storing means includes a plurality of tables corresponding to characteristics of the recording head.

24. An ink jet recording head driving method for an ink jet recording apparatus wherein recording is effected by ejecting ink from an ink jet recording head onto a recording material by driving an electrothermal transducer in the ink jet recording head, said method comprising the steps of:

supplying a first driving pulse to cause the electrothermal transducer to generate ejecting energy insufficient to eject the ink;

providing a rest period after the first driving pulse supplying step;

supplying a second driving pulse to cause the electrothermal transducer to eject the ink; and controlling an ejection amount of the ink by modulating the first driving pulse and the rest period, wherein in said controlling step, a minimum of the rest period is limited, a minimum of the length of the rest period is determined such that a current waveform in the electrothermal transducer caused by application of the first driving pulse does not combine with a current waveform caused by application of the second driving pulse.

25. A method according to claim 24, wherein the electrothermal transducer includes a heater which generates thermal energy, and the ink jet recording head applies the thermal energy to the ink to generate a bubble to eject the ink.

26. A method according to claim 24, wherein the electrothermal transducer includes a heater which generates thermal energy, and the ink jet recording head applies the thermal energy to the ink to generate a bubble to eject the ink.

27. A method according to claim 24, further comprising a detecting step for detecting a temperature of the recording head, wherein said controlling step modulates a pulse applied to the electrothermal transducer based on the temperature of the recording head detected in said detecting step.

28. A method according to claim 24, wherein the first driving signal is modulatable within a changing region, and in the changing region, the length of the first driving pulse is insufficient to eject the ink.

29. A method according to claim 24, further comprising the step of storing information for changing the first driving pulse and the rest period, wherein said controlling step determines the lengths of the first driving pulse and the rest period based on information stored in said storing step.

30. A method according to claim 29, wherein the information corresponds to the first driving pulse and the rest period determined for each of ejection amount ranges.

31. A method according to claim 29, wherein said storing step utilizes a table for determining the lengths of the first driving pulse, the second driving pulse, and the rest period.

32. A method according to claim 31, wherein said storing step utilizes a plurality of tables corresponding to characteristics of the recording head.

* * * * *

UNITED STATES PATENT AND TRADEMARK OFFICE

CERTIFICATE OF CORRECTION

PATENT NO. : 6,331,039 B1
DATED : December 18, 2001
INVENTOR(S) : Iwasaki et al.

It is certified that error appears in the above-identified patent and that said Letters Patent is hereby corrected as shown below:

Title page,
Item [56], References Cited, FOREIGN PATENT DOCUMENTS,
"5092565" should read -- 5-92565 --;
"5169658" should read -- 5-169658 --;
"5169659" should read -- 5-169659 --;
"5220963" should read -- 5-220963 --;
"59123670" should read -- 59-123670 --;
"59138461" should read -- 59-138461 --;
"60071260" should read -- 60-71260 --; and
"54056847" should read -- 54-56847 --.

Item [57], ABSTRACT,
Line 5, "one ejection" should read -- ejection --.

Column 1,
Line 42, "Ink" should read -- ink --.
Line 44, "In" (first occurrence) should read -- in --.

Column 2,
Line 15, "Ki=δVd/δTH[pl/ºC/drop]" should read -- KH=δVd/δTH[pl/ºC/drop] --
Line 17, "KR" should read -- KH --.
Line 51, "V interval" should read -- interval --.

Column 3,
Line 58, "It" should read -- it --.

Column 7,
Line 43, "Ls" should read -- is --.

Column 8,
Line 1, "In" should read -- in --.
Line 3, "Is" should read -- is --.
Line 38, "engagaable" should read -- engageable -- and "is" should read -- are --.

Column 9,
Line 14, "La" should read -- is --.

UNITED STATES PATENT AND TRADEMARK OFFICE

CERTIFICATE OF CORRECTION

PATENT NO. : 6,331,039 B1
DATED : December 18, 2001
INVENTOR(S) : Iwasaki et al.

It is certified that error appears in the above-identified patent and that said Letters Patent is hereby corrected as shown below:

Column 10,
Line 8, "Bide" should read -- side --.
Line 49, "Shown" should read -- shown --.

Column 11,
Line 34, "HO" should read -- HQ --.
Line 58, "tho" should read -- the --.

Column 15,
Line 2, "the the" should read -- the --.
Line 13, "4,558.333" should read -- 4,558,333 --.

Signed and Sealed this

Thirteenth Day of August, 2002

*Attest:*

*Attesting Officer*

JAMES E. ROGAN
*Director of the United States Patent and Trademark Office*